US011653141B2

(12) United States Patent
Tong et al.

(10) Patent No.: US 11,653,141 B2
(45) Date of Patent: May 16, 2023

(54) ACTIVE NOISE CONTROL HEADPHONES

(71) Applicant: Bestechnic (Shanghai) Co., Ltd., Shanghai (CN)

(72) Inventors: Weifeng Tong, Shanghai (CN); Liang Zhang, Shanghai (CN); Qian Li, Shanghai (CN); Mingliang Xu, Shanghai (CN)

(73) Assignee: BESTECHNIC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 17/975,921

(22) Filed: Oct. 28, 2022

(65) Prior Publication Data

US 2023/0063298 A1 Mar. 2, 2023

Related U.S. Application Data

(63) Continuation of application No. 17/718,667, filed on Apr. 12, 2022, now Pat. No. 11,595,748, which is a (Continued)

(30) Foreign Application Priority Data

Dec. 13, 2019 (CN) ..... 201911279326.1
Dec. 13, 2019 (CN) ..... 201911279620.2
(Continued)

(51) Int. Cl.
*H04R 1/10* (2006.01)
*H04R 5/033* (2006.01)
*G10K 11/178* (2006.01)

(52) U.S. Cl.
CPC ..... *H04R 1/1083* (2013.01); *G10K 11/1783* (2018.01); *G10K 11/17854* (2018.01); *H04R 5/033* (2013.01); *H04R 2460/01* (2013.01)

(58) Field of Classification Search
CPC ..... H04R 3/04; H03G 5/005; H03G 5/025; H03G 5/165; H03G 2201/508;
(Continued)

(56) References Cited

U.S. PATENT DOCUMENTS 8,144,897 B2 3/2012 Ranta
8,189,803 B2 5/2012 Bergeron et al.
(Continued)

FOREIGN PATENT DOCUMENTS

CN 106255003 A 12/2016
CN 108174320 A 6/2018
CN 109346055 A 2/2019

*Primary Examiner* — Kile O Blair
(74) *Attorney, Agent, or Firm* — Bayes PLLC

(57) ABSTRACT

Embodiments of active noise control (ANC) headphones and operating methods thereof are disclosed herein. In one example, a headphone includes a speaker, an internal microphone, and a processor. The speaker is configured to play an audio of interest based on an audio source signal. The internal microphone is configured to obtain a mixed audio signal including a noise signal and the audio of interest played by the speaker. The processor is configured to determine a first current system parameter of the headphone based on the mixed audio signal at a first time point, and determine if the first current system parameter of the headphone is higher than a predetermined threshold to determine if the headphone is worn by a user.

20 Claims, 20 Drawing Sheets

Related U.S. Application Data continuation of application No. 17/151,545, filed on Jan. 18, 2021, now Pat. No. 11,330,359, which is a continuation of application No. 17/068,765, filed on Oct. 12, 2020, now Pat. No. 11,317,192, which is a continuation of application No. 16/836,919, filed on Apr. 1, 2020, now Pat. No. 10,834,494, which is a continuation of application No. PCT/CN2020/082478, filed on Mar. 31, 2020.

(30) Foreign Application Priority Data

| | | |
|---|---|---|
| Dec. 13, 2019 | (CN) | 201911282166.6 |
| Dec. 13, 2019 | (CN) | 201911282376.5 |
| Dec. 13, 2019 | (CN) | 201911283265.6 |
| Dec. 13, 2019 | (CN) | 201911283305.7 |
| Jan. 8, 2020 | (CN) | 202010016249.7 |
| Feb. 26, 2020 | (CN) | 202010118025.7 |
| Feb. 26, 2020 | (CN) | 202010118096.7 |
| Mar. 11, 2020 | (CN) | 20201064338.6 |

(58) Field of Classification Search

CPC ..... H04S 7/301; H04S 7/307; G10K 11/1781; G10K 11/17827; G10K 11/17821; G10K 2210/30232; G10K 2210/3033; G10K 2210/3048; G10K 2210/3055

See application file for complete search history.

(56) References Cited

U.S. PATENT DOCUMENTS

| | | | |
|---|---|---|---|
| 2001/0053228 | A1 | 12/2001 | Jones |
| 2004/0184623 | A1 | 9/2004 | Johannsen et al. |
| 2007/0076897 | A1 | 4/2007 | Philipp |
| 2013/0039507 | A1 | 2/2013 | Park et al. |
| 2016/0241948 | A1 | 8/2016 | Liu et al. |
| 2017/0013345 | A1 | 1/2017 | Kumar et al. |
| 2017/0053638 | A1 | 2/2017 | Zhou et al. |
| 2017/0053639 | A1 | 2/2017 | Lu et al. |
| 2017/0200442 | A1 | 7/2017 | Yamabe et al. |
| 2017/0200444 | A1 | 7/2017 | O'Connell et al. |
| 2018/0286374 | A1 | 10/2018 | Cattell et al. |

600

800

900

1000

1100

1500

ACTIVE NOISE CONTROL HEADPHONES

CROSS-REFERENCE TO RELATED APPLICATIONS

This application is a continuation of U.S. patent application Ser. No. 17/718,667, filed on Apr. 12, 2022, entitled "ACTIVE NOISE CONTROL HEADPHONES," which is a continuation of U.S. patent application Ser. No. 17/151,545, filed on Jan. 18, 2021, entitled "ACTIVE NOISE CONTROL HEADPHONES," which is a continuation of U.S. patent application Ser. No. 17/068,765, filed on Oct. 12, 2020, entitled "ACTIVE NOISE CONTROL HEADPHONES," which is a continuation of U.S. patent application Ser. No. 16/836,919, filed on Apr. 1, 2020, entitled "ACTIVE NOISE CONTROL HEADPHONES," which is a continuation of International Application No. PCT/CN2020/082478, filed on Mar. 31, 2020, entitled "ACTIVE NOISE CONTROL HEADPHONES," which claims the benefit of priorities to Chinese Patent Application No. 201911283305.7, filed on Dec. 13, 2019, Chinese Patent Application No. 201911283265.6, filed on Dec. 13, 2019, Chinese Patent Application No. 201911282166.6, filed on Dec. 13, 2019, Chinese Patent Application No. 201911282376.5, filed on Dec. 13, 2019, Chinese Patent Application No. 201911279326.1, filed on Dec. 13, 2019, Chinese Patent Application No. 201911279620.2, filed on Dec. 13, 2019, Chinese Patent Application No. 202010016249.7, filed on Jan. 8, 2020, Chinese Patent Application No. 202010118096.7, filed on Feb. 26, 2020, Chinese Patent Application No. 202010118025.7, filed on Feb. 26, 2020, and Chinese Patent Application No. 202010164338.6, filed on Mar. 11, 2020, all of which are incorporated herein by reference in their entireties.

BACKGROUND

Embodiments of the present disclosure relate to headphones.

Loudspeakers, including headphones, have been widely used in daily life. Headphones can include a pair of small loudspeaker drivers worn on or around the head over a user's ears, which convert an electrical signal to a corresponding acoustic signal.

Active noise control (ANC), also known as noise cancellation, or active noise reduction (ANR), is a method for reducing unwanted sound by the addition of a second sound specifically designed to cancel the first sound. ANC can be achieved by a feedback loop and/or a feed forward loop. Conventional ANC headphones, however, suffer from issues such as volume reduction and audio quality loss because the audio being played may be affected by the ANC as well. Also, conventional ANC headphones are vulnerable to low-frequency noise (e.g., less than 100 Hz) with high amplitude due to saturation of the low-frequency noise.

SUMMARY

Embodiments of ANC headphones and operating methods thereof are disclosed herein.

In one example, a headphone for ANC includes a speaker, an internal microphone, a processor, and a filter function module. The speaker is configured to play an audio based on a first audio source signal. The internal microphone is configured to obtain a mixed audio signal comprising a noise signal and a second audio source signal based on the audio of interest played by the speaker. The processor is configured to determine a current system parameter of the ANC headphone based on the mixed audio signal at a first time point and determine a current parameter of a filter function module based on the current system parameter of the ANC headphone and pre-tested data. The filter function module is to perform ANC based on the determined current parameter of the filter function module.

In another example, a system for ANC includes a memory and at least one processor. The memory is configured to store code. The at least one processor, when the code is executed, is configured to receive a mixed audio signal comprising a noise signal and an audio source signal based on an audio of interest played by a speaker, determine a current system parameter of the ANC headphone based on the mixed audio signal at a first time point, and determine a current parameter of a filter function module based on the current system parameter of the ANC headphone and pre-tested data.

In a different example, a method for ANC is disclosed. An audio of interest is played based on a first audio signal by a speaker. A mixed audio signal including a noise signal and a second audio signal based on the audio of interest played by the speaker is obtained by a microphone. A current system parameter of the ANC headphone is determined by a processor based on the current system parameter and pre-tested data. A filter function module is adjusted by the processor based on the current system parameter and pre-tested data. A noise-controlled audio signal to be played by the speaker is generated by the processor based on the adjusted filter function module.

This Summary is provided merely for purposes of illustrating some embodiments to provide an understanding of the subject matter described herein. Accordingly, the above-described features are merely examples and should not be construed to narrow the scope or spirit of the subject matter in this disclosure. Other features, aspects, and advantages of this disclosure will become apparent from the following Detailed Description, Figures, and Claims.

BRIEF DESCRIPTION OF THE DRAWINGS

The accompanying drawings, which are incorporated herein and form part of the specification, illustrate the presented disclosure and, together with the description, further serve to explain the principles of the disclosure and enable a person of skill in the relevant art(s) to make and use the disclosure.

DETAILED DESCRIPTION

Figure 1:
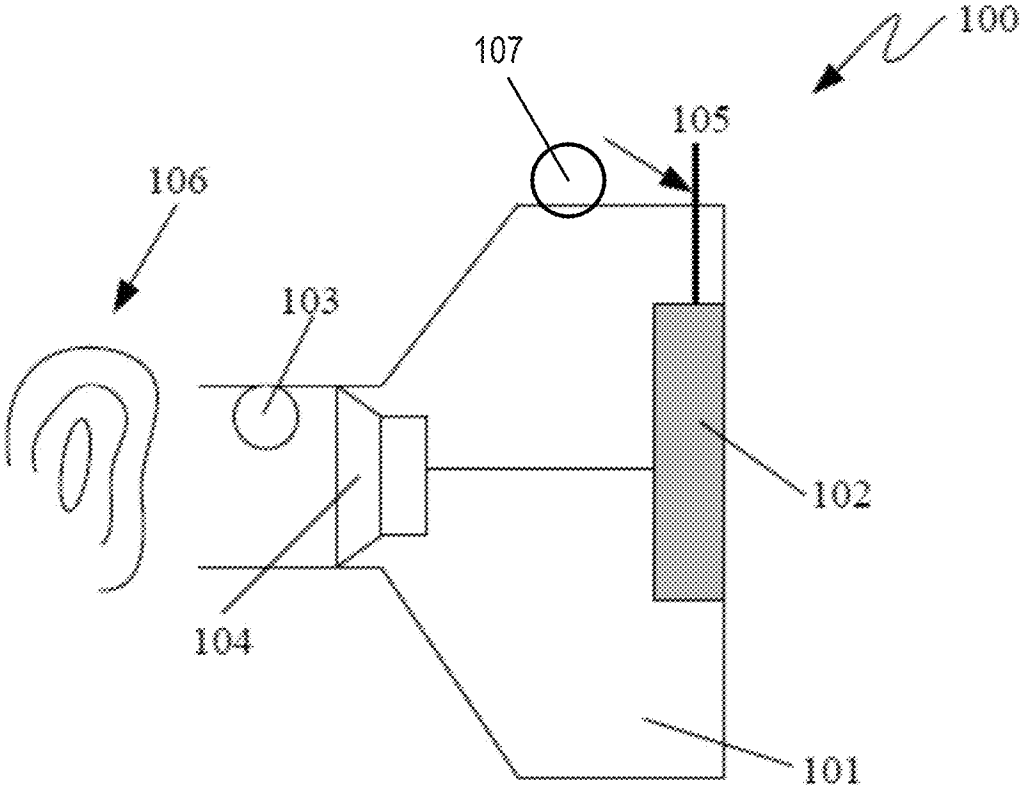
FIG. 1 is a schematic diagram illustrating an exemplary ANC headphone in accordance with an embodiment of the present disclosure.

Although specific configurations and arrangements are discussed, it should be understood that this is done for illustrative purposes only. It is contemplated that other configurations and arrangements can be used without departing from the spirit and scope of the present disclosure. It is further contemplated that the present disclosure can also be employed in a variety of other applications.

It is noted that references in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it is contemplated that such feature, structure or characteristic may also be used in connection with other embodiments whether or not explicitly described.

In general, terminology may be understood at least in part from usage in context. For example, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

It is appreciated that all the processors disclosed herein can be an integrated general-purpose processor configured to perform different functions mentioned thereof, or are individual processors specifically designed for the disclose function only. In some embodiments, the processors can be an integrated part of the ANC headphone or a standalone component suitable for performing such disclosed functions.

As will be disclosed in detail below, among other novel features, the ANC headphones disclosed herein can generate an ANC signal to ANC (e.g., remove or reduce the environmental noises) using a feed forward loop and/or a feedback loop, or can generate a talk-through signal using a talk-through loop and/or the feedback loop disclosed. The parameters of one or more components (e.g., amplifiers, filters, etc.) of each loop are adjusted dynamically based on a relationship between the system parameters (e.g., the system function of the headphone, the signal parameters of the signals obtained up by the feed forward loop, etc.) and the parameters of one or more components to be adjusted, indicated by pre-tested data (e.g., experiment(s) conducted by simulating the actual working scenarios), and the current system parameters determined under the current working scenario. By adjusting the parameters of one or more components, the ANC headphones can reduce or even eliminate the impact of ANC/talk-through signal on audio signals other than the noise signal, thereby improving user experience in various working scenarios, such as listening to the music and/or talk-through sound.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 is a schematic diagram illustrating an exemplary ANC headphone 100 in accordance with an embodiment of the present disclosure. ANC headphone 100 may be a wired or wireless loudspeaker that can be worn on or around the head over a user's ear 106 or inside ear 106. In some embodiments, ANC headphone 100 may be an earbud (also known as earpiece), an open earphone, a semi-open earphone, or a wireless headphone that can be plugged into the user's ear canal when ANC headphone 100 is worn by the user. In some embodiments, ANC headphone 100 may be part of a headset, which is physically held by a band over the head of the user. ANC headphone 100 may include a processor 102, an internal microphone 103, a speaker 104, an audio receiving unit 105, and an external microphone 107. Audio receiving unit 105 may be an antenna for wirelessly receiving an audio source signal from an audio source (not shown) or an audio cable connected to the audio source for transmitting the audio source signal to processor 102. The audio source may include, but not limited to, a handheld device (e.g., dumb or smart phone, tablet, etc.), a wearable device (e.g., eyeglasses, wrist watch, etc.), a radio, a music player, an electronic musical instrument, an automobile control station, a gaming console, a television set, a laptop computer, a desktop computer, a netbook computer, a media center, a set-top box, a global positioning system (GPS), or any other suitable device. In some embodiments, the audio source signal is a music signal from a music source, such as a phone or a music player. In some embodiments, the audio source signal is a voice signal from a voice source, such as a phone.

Speaker 104 may be any suitable electroacoustic transducer that converts an electrical signal (e.g., representing the audio information provided by the audio source) to a corresponding audio sound. In some embodiments, speaker 104 is configured to play an audio based on an audio signal. Internal microphone 103 may be any transducer that converts an audio sound into an electrical signal. Internal microphone 103 may be disposed inside the ear canal when ANC headphone 100 is worn by the user to obtain a mixed audio signal that includes an environmental noise signal and an audio source signal based on the audio played by speaker 104. That is, by disposing internal microphone 103 inside the user's ear canal, any sound in the ear canal can be obtained up by internal microphone 103, which includes the audio of interest currently being played by speaker 104 (e.g., audio source signal) and any environmental noises to be reduced or removed by processor 102. As internal microphone 103 cannot separate the audio of interest from the noises, the mixed sounds are converted by internal microphone 103 into a first mixed audio signal that includes both environmental noise signal and audio source signal. In some embodiments, the audio of interest may be canceled from the mixed audio signal to generate a first cancel audio signal using an echo-cancel module 207 (will be disclosed in detail below).

External microphone 107 may be any transducer that converts an audio sound into an electrical signal as well. Different from internal microphone 103, external microphone 107 is disposed outside the user's ear canal when ANC headphone 100 is worn by the user, according to some embodiments. External microphone 107 may be configured to obtain environmental noises outside the ear canal. It is understood that in some embodiments, external microphone 107 may receive a second mixed audio signal (e.g., a second mixed audio signal) including at least the environmental noise signal. The first and the second mixed audio signal may be used for performing ANC. For example, the feedback ANC filter and the feed forward ANC filter may be applied respectively on the first and the second mixed audio signal for generating an ANC signal, which may be added to the audio of interest for speaker 104 to play. The ANC signal may only correspond to the noise because of the cancel function.

In some embodiments, the user wears ANC headphone 100 may be interested in hearing certain sounds (i.e., talk-through sounds) outside the ear canal. In one example, when the user walks outside wearing ANC headphone 100, the user may want to hear traffic sounds, e.g., horn sound, to be alerted by any safety risks. In another example, the user may want to talk to someone when wearing ANC headphone 100. External microphone 107 may obtain up the talk-through sound and a leakage (e.g., the audio of interest played by the speaker that leaks out the ear canal). In some embodiments, the leakage may be canceled from the second mixed audio signal to generate a talk-through audio signal using a talk-through module (e.g., including a talk through a filter for filtering the talk-through signal and a de-leakage filter performing substantially the same function as echo-cancel module 207 for canceling the leakage). In some embodiments, the talk-through audio signal may eventually be played by speaker 104 inside the user's ear canal. That is, in some embodiments, the audio played by speaker 104 includes the talk-through sound alone or with any other audio of interest from the audio source (e.g., music). By using the de-leakage filter to filter out the leakage from the talk-through signal, the talk-through signal can avoid affecting (e.g., reduce or cancel out or increase) the audio of interest played by speaker 104.

In some embodiments, processor 102 is coupled to a memory and may be any suitable integrated circuit (IC) chips (implemented as an application-specific integrated circuit (ASIC) or a field-programmable gate array (FPGA) that can perform audio signal processing functions. In some embodiments, the memory is configured to store code, when executed, causing processor 102 to perform the functions disclosed herein.

In some embodiments, processor 102 may be configured to adjust the parameters of the filter function module (i.e., the filter function parameters) and or the parameters of the cancel function module (e.g., the parameters of the echo-cancel filter, the de-leakage filter, etc.). In some embodiments, the filter function parameters may be adjusted such that the ANC signal (e.g., generated based on the first mixed audio signal and the second mixed audio signal) may provide the best ANC performance under the current working scenario. In some embodiments, the cancel function parameters may be adjusted such that the audio of interest may be canceled from the ANC signal to the greatest extent under the current working scenario. In some embodiments, filter function parameters and/or cancel function parameters may be adjusted based on the relationships with system parameters of the ANC headphones (e.g., the transfer function (e.g., from the speaker to the internal microphone) of the ANC headphones, parameters of the audio signal obtained by the internal microphone, the ratio between the environmental noise obtained outside the ear canal and the inside noise obtained inside the ear canal, etc.). In some embodiments, processor 102 may be configured to obtain the system parameters. The relationship may be acquired by testing data (e.g., conducting N different tests revealing the relationships between the filter function parameters and the system parameters in different scenarios).

In some embodiments, processor 102 is also configured to perform cancel function by reducing or removing the audio signal of interest from the first mixed audio signal obtained by internal microphone 103 to generate a cancel audio signal. The cancel signal may include a pure noise signal (when the audio signal of interest can be completely removed) or a noise signal with reduced audio of interest signal. In some embodiments, processor 102 is further configured to perform ANC function by reducing or removing the noise signal from the audio signal of interest to be played by speaker 104 based on the cancel audio signal.

In some embodiments, the cancel function performed by processor 102 may also include reducing or removing the leakage from the second mixed audio signal obtained by external microphone 107 to generate a talk-through signal (e.g., filter the environmental noise using a talk-through filter). The talk-through signal may include a purely talk-through signal (when the leakage can be completely removed) or a talk-through signal with reduced leakage. By applying the cancel function, the degree to which the audio signal of interest may be affected by the ANC function and/or talk-through function can be significantly reduced or even minimized. Thus, the noise control performance may be significantly increased, thereby preventing howling because of the leakage.

Figure 2:
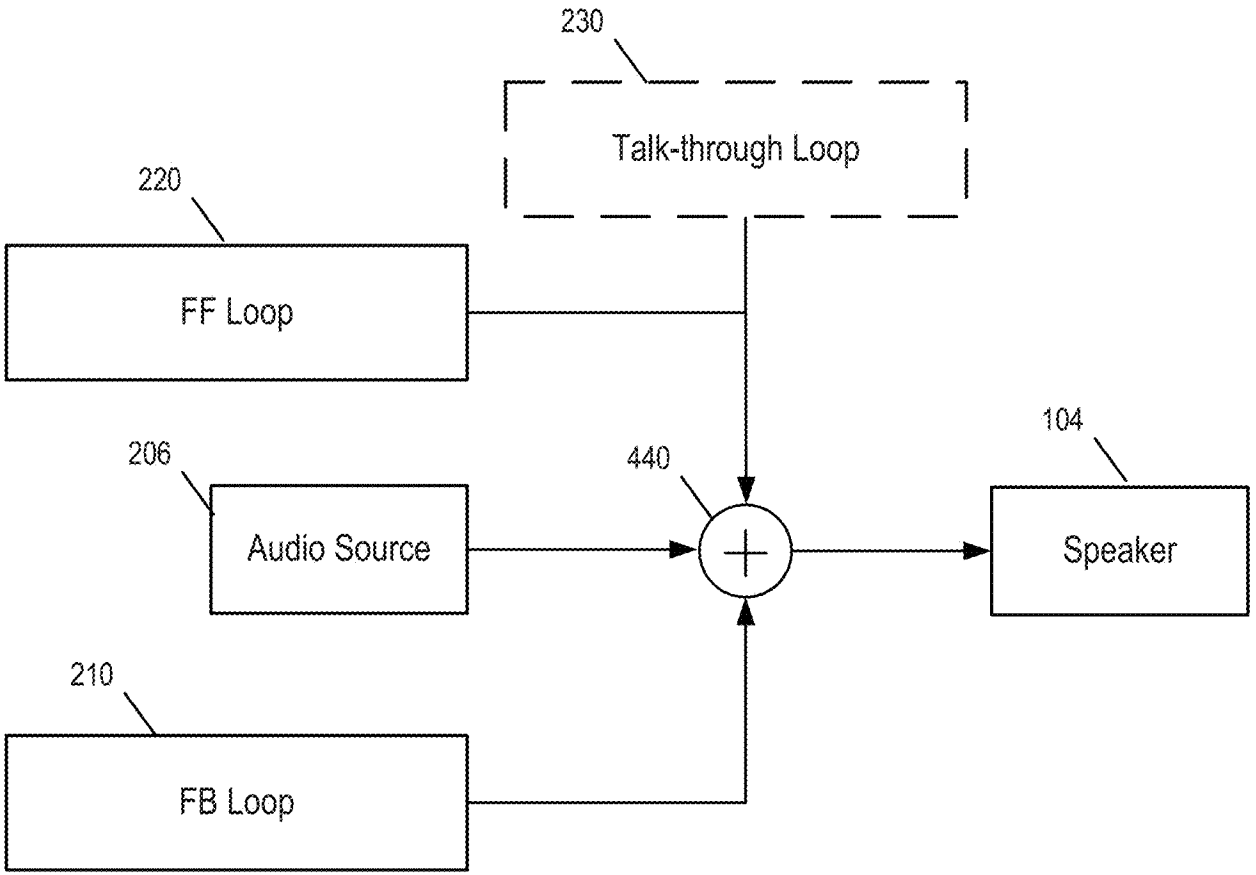
FIG. 2 is a block diagram illustrating the exemplary ANC headphone illustrated in FIG. 1 in accordance with an embodiment of the present disclosure.

FIG. 2 is a block diagram illustrating the exemplary ANC headphone illustrated in FIG. 1 in accordance with an embodiment of the present disclosure. As will be disclosed in detail below, among other novel features, the ANC headphones disclosed herein can generate an ANC signal to ANC (e.g., remove or reduce the inside noises) based on a feedback loop 210 and/or a feed forward loop 220, or a talk-through signal based on a talk-through loop 230 and/or feedback loop 210 disclosed. For example, feedback loop 210 includes, among other components, internal microphone 103 and a feedback ANC filter. The feed forward loop includes, among other components, external microphone 107 and a feed forward ANC filter. The ANC headphones may perform the ANC by generating an ANC signal based on the first mixed audio signal (e.g., filtering the first mixed audio signal using the feedback ANC filter) and the second mixed audio signal (e.g., filtering the second mixed audio signal using the feed forward ANC filter) that could remove or reduce (e.g., cancel out) the inside noises when listening to music or another audio signal of interest or when not listening to music or another audio signal of interest. The ANC signal may be combined with an audio of interest played by an audio source 206 by an adder 440. The noise-controlled audio of interest may be played a speaker 104.

In some embodiments, the talk-through loop can share external microphone 107 with feed forward loop 220 and includes, among other components, a talk-through filter. External microphone 107 can also obtain the environmental noise and leakages of the audio of interest played by speaker 104 (e.g., the audio played by the speaker that leaks out the ear canal) for talk-through functions. The ANC headphones can generate a talk-through signal based on talk-through loop 230. For example, the ANC headphone can generate the talk-through signal based on the second mixed audio signal by canceling out (e.g., filtering out) the leakage using a talk-through filter module (e.g., including an echo-cancel filter).

In some embodiments, a filter function can be implemented by the ANC headphones disclosed herein to generate the ANC signal (e.g., a noise-controlled audio source signal) for ANC. In some embodiments, the filter function module for the filter function includes among other components, a first amplifier and a second amplifier, and a first ANC filter (e.g., the feedback ANC filter) and a second ANC filter (e.g., feed forward ANC filter or the talk-through filter). In some embodiments, the first amplifier and the first ANC filter can be utilized by feedback loop 210. The second amplifier and the second ANC filter can be utilized by feed forward loop 220. In some embodiments, when performing ANC, parameters of the filter function module can be adjusted for better ANC performance when the ANC headphones are being used in different working scenarios (e.g., worn by different canal structures, wearing manners, with different ANC headphones' conditions and parameters associated with the components, etc.). For example, the filter function parameters can include the on/off of the first and the second ANC filter, the amplification factor of the first and the second amplifier, and/or the filter coefficient of the first and the second ANC filter. The filter function parameters can be adjusted to cancel out the inside noise (e.g., by generating the noise-controlled audio source signal, negative to the inside noise signal) to the largest extent.

In some embodiments, the filter function parameters can also be parameters of an equalization filter or part of the equalization filter applied when playing the music. The equalization filter can be applied to balance the mixed audio signal received by the internal microphone under different working scenarios. When ANC is off, or there is no ANC, the equalization filter can be applied to balance the audio signal (e.g., music, voice) received by the internal microphone under different working scenarios. Then under different working scenarios, the user can hear almost the same audio signal. In some embodiments, the equalization filter can include a fixed equalization filter and a variant equalization filter. The fixed equalization filter doesn't change under different working scenarios. The variant equalization filter is adjusted under different working scenarios. When the filter function parameters being the parameters of the equalization filter or part of the equalization filter, the determination method may be the same as will be disclosed in detail below. The application of the equalization filter can be independent or in addition to the ANC function.

In some embodiments, when performing talk-through related functions, the filter function may include the second amplifier and a talk-through module including the talk-through filter and a de-leakage filter (e.g., for canceling a leakage of the audio of interest leaked to the outside of the ear canal). For example, the filter function parameters can include the on/off of the talk-through filter and the de-leakage filter, the amplification factor of the second amplifier, and/or the filter coefficient of the talk-through filter and the de-leakage filter. The talk-through filter can be adjusted to enable the user to hear sounds outside the ear canal more naturally and clearly. The de-leakage filter can be adjusted to reduce the impact of the leakage (e.g., cancel out the audio leakage from the external microphone signal) to the largest extent.

As will be disclosed in detail below, among other novel features, when performing the ANC, the ANC headphones disclosed herein can reduce or remove the impact of ANC on audio signals other than the inside noise signal, while when performing the talk-through function, the ANC headphones disclosed herein can enable the user to hear sounds outside the ear canal more naturally and clearly. Thereby the ANC headphones disclosed herein can improve user experience in various usage scenarios, such as listening to the music and/or talk-through sound.

In some embodiments, a cancel function can be implemented by the ANC headphones disclosed herein to cancel out the audio signal of interest from the ANC signal before ANC, such that the ANC signal can be purely noise signal (e.g., the environmental noise), which does not substantively affect the volume and/or quality of the audio signal of interest (e.g., the audio being played, a prompt tone, a sub-audible reference tone, the talk-though sound, leakage, etc.). For example, the cancel function may include an echo-cancel filter, a high-pass, a low-pass filter, or a band-stop filter. In some embodiments, the cancel function can be utilized by the feedback loop, the feed forward loop and/or the talk-through loop.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

Figure 3:
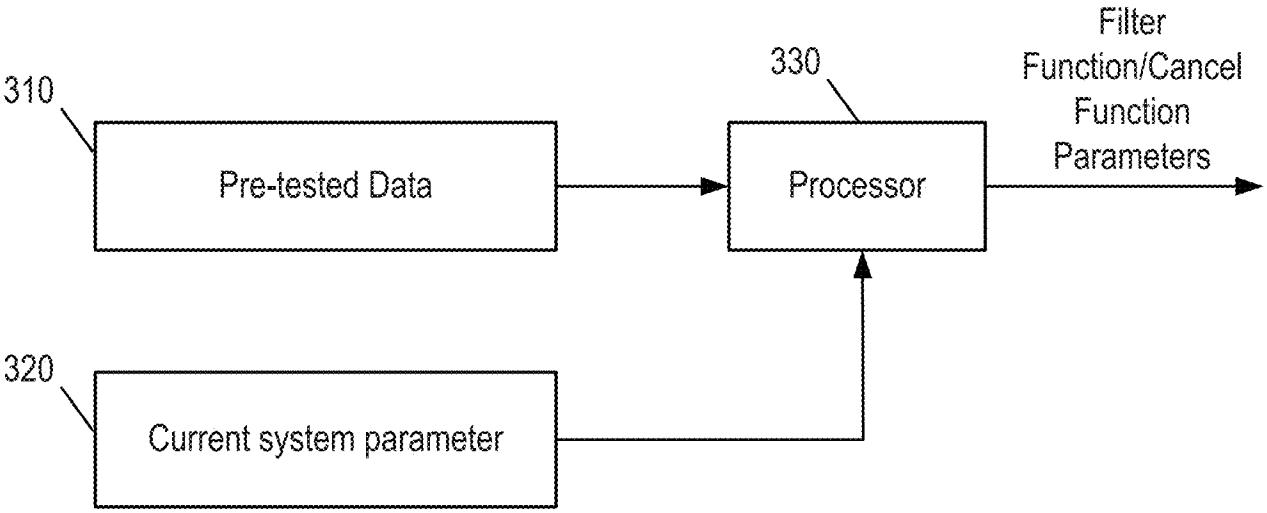
FIG. 3 is a block diagram illustrating an exemplary process for determining the filter function parameters, in accordance with an embodiment of the present disclosure.

FIG. 3 is a block diagram illustrating an exemplary process for determining the filter function parameters, in accordance with an embodiment of the present disclosure. In some embodiments, filter function parameters and/or cancel function parameters may be adjusted by a processor 330 based on the relationships with the system parameters of the ANC headphones (e.g., the transfer function of the ANC headphones, parameters of the audio signal obtained by internal microphone 103, the ratio between the environmental noise obtained outside the ear canal and the inside noise obtained inside the ear canal, etc.) and current system parameter 320. The relationship may be acquired by pre-tested data 310 (e.g., conducting N(e.g., 1, 2, 3, 4, 10, etc.) different test(s) revealing the relationships between the filter function parameters and the system parameters in different working scenarios). Pre-tested data 310 may be N (e.g., 1, 2, 3, 4, 10, etc.) pairs of the filter function parameters and the system parameters obtained in N different working scenarios In some embodiments, the different working scenarios may include different canal structures, wearing manners (e.g., the wearing tightness), ANC headphones' conditions, parameters associated with the components within the ANC headphones, whether the ANC headphone is worn by the user, or any of the combination thereof.

In some embodiments, when obtaining the pre-tested data for preforming the ANC, in different working scenarios, the filter function parameters may be determined such that the inside noise received by the internal microphone is minimized. When obtaining the pre-tested data for preforming the talk-through function, in different working scenarios, the filter function parameters may be determined such that the inside noise received by the internal microphone is the closest (e.g., ideally identical) to the environmental noise obtained by the external microphone or to the inside noise when the headphones aren't worn by the user. System parameters corresponding to the determined filter function parameters may be obtained and be paired with the determined filter function parameters to constitute a data point of pre-tested data 310. Details of obtaining the pre-tested data will be disclosed in detail below.

In some embodiments, before using the pre-tested relationships between the filter function parameters and the system parameters to determine the current filter function parameters, the result (e.g., the curve line indicating the relationship) of the N different tests may be calibrated (e.g., by applying an adjusting rate) to fit the current condition of the ANC headphones (e.g., the condition of different components of the ANC headphones). For example, an N+1th test can be conducted for generating an adjusting rate for the calibration. The adjusting rate can be applied to the N different tests for calibrating the current relationship between the filter function parameters and the system parameters to better fit the current condition of the ANC headphones.

In some embodiments, for each ANC headphone, a N+1th test and/or at least one of the N tests can be conducted for generating a gain for compensating the sensitivity difference of the components (e.g., the microphones and the speaker) of different ANC headphones. In some embodiments, the gain for the ANC headphone may be applied to the rest of the pre-tested data before being used for adjusting the filter function for better ANC performance.

In some embodiments, processor 102 may be configured to obtain the current system parameters. For example, processor 102 may be configured to obtain the current system parameters such as the transfer function of the ANC headphones (e.g., the transfer function from the speaker to the internal microphone), parameters of the audio signal (e.g., the mixed audio signal) obtained by internal microphone 103 (e.g., the time domain distribution, the frequency domain distribution, energy in time and/or frequency domain of the mixed audio signal), the ratio between the environmental noise obtained outside the ear canal and/or the inside noise obtained inside the ear canal, etc. of the ANC headphones under the current working scenario. In some embodiments, processor 102 may also be configured to determine the filter function parameters and/or cancel function parameters for the ANC headphones based on the pre-tested relationships and the obtained current system parameters.

Figure 4:
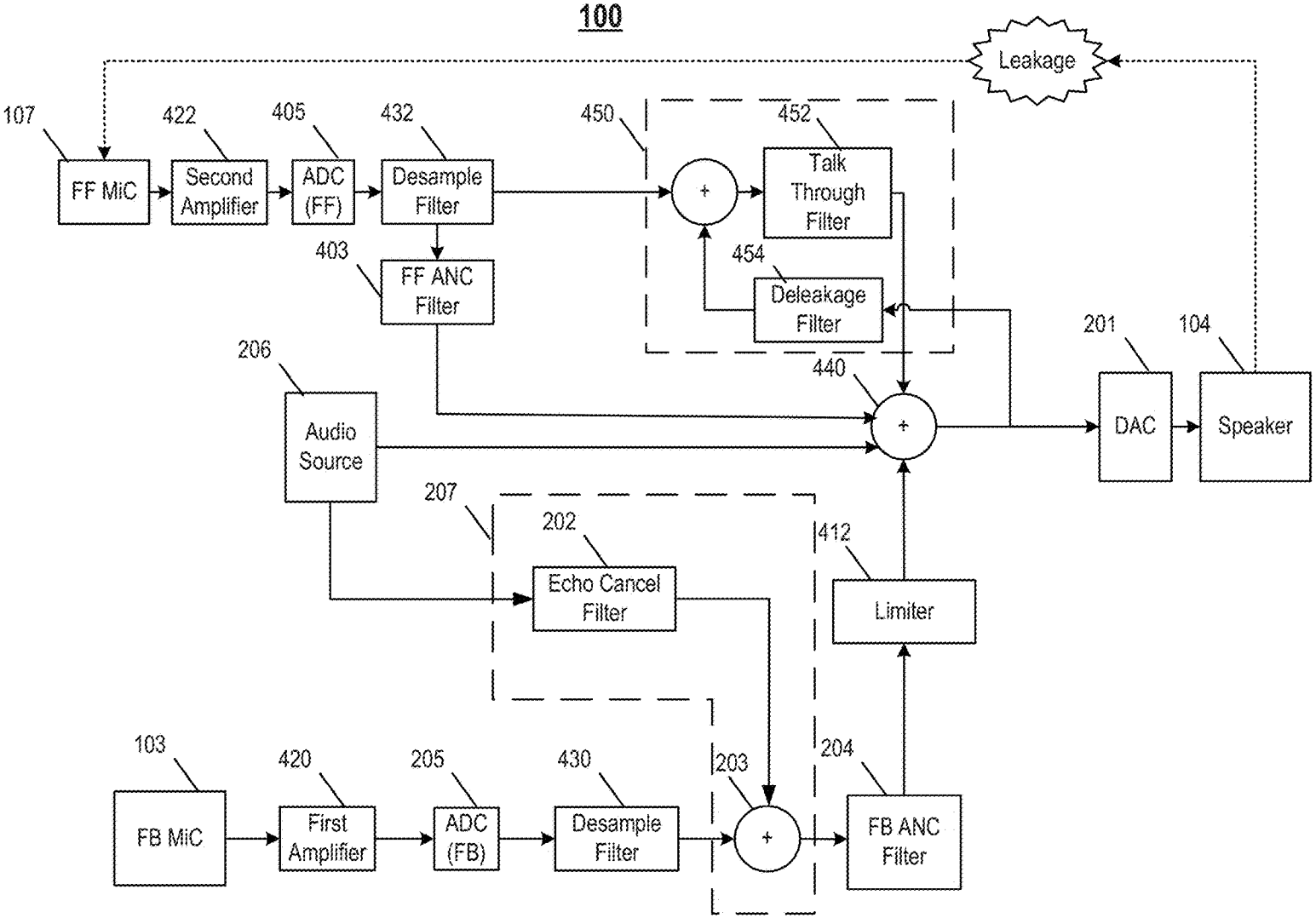
FIG. 4 is a detailed block diagram illustrating an exemplary ANC headphone illustrated in FIG. 1 in accordance with an embodiment of the present disclosure.

FIG. 4 is a detailed block diagram illustrating an exemplary ANC headphone 100 illustrated in FIG. 1 in accordance with an embodiment of the present disclosure. It is understood that not every component shown in FIG. 4 may be needed for different embodiments. In some embodiments, ANC headphone 100 includes a feedback loop, a feed forward loop, and speaker 104. Audio source 206 can provide a first audio source signal (e.g., a music signal, a prompt tone and/or a sub-audible reference tone) to ANC headphone 100, for example, via an antenna or an audio cable (e.g., audio receiving unit 105 shown in FIG. 1). In some embodiments, the first audio source signal is a digital signal that can be converted by DAC 201 to an analog signal and played by speaker 104. That is, speaker 104 may play an audio based on the first audio source signal in an analog format.

In some embodiments, in the feedback loop, the audio played by speaker 104 is obtained by internal microphone 103 along with environmental noises in the ear canal in which internal microphone 103 is disposed. Internal microphone 103 can obtain a first mixed audio signal including a noise signal based on the environmental noise and a second audio source signal based on the audio played by speaker 104. That is, the first mixed audio signal obtained by internal microphone 103 is based on both the audio of interest (e.g., the music signal, the prompt tone and/or the sub-audible reference tone) and the noises to be reduced or removed, according to some embodiments. In some embodiments, the first mixed audio signal may be amplified (e.g., with a rate between 0-1) by a first amplifier 420. In some embodiments, the first mixed audio signal is an analog signal that can be converted by ADC 205 to a digital signal. In some embodiments, the digital signal can further be de-sampled (e.g., downsample) by a de-sample filter/decimator 430. This may reduce the order of the filter and thus reduce the size of the functioning circuit of ANC headphone 100, therefore reduce the production cost. The processed first mixed audio signal can be added to an adder 203 for generating the echo-cancel audio signal.

In some embodiments, the feedback loop can also include an echo-cancel module 207 that is configured to reduce the second audio source signal from the first mixed audio signal based on the first audio source signal to generate an echo-cancel audio signal. In some embodiments, echo-cancel module 207 is able to minimize or even remove the second audio source signal from the first mixed audio signal. For example, echo-cancel module 207 may include an echo-cancel filter 202 and adder 203 operatively coupled to one another. In some embodiments, echo-cancel filter 202 may be any suitable digital filters, such as a finite impulse response (FIR) filter, an infinite impulse response (IIR) filter, or a combination of FIR and IIR filters. In some embodiments, echo-cancel filter 202 can be configured to receive the first audio source signal from audio source 206 and generate a first cancellation signal based on the first audio source signal. In some embodiments, the echo-cancel filter is sensitive to low-frequency signals, such as less than 3 KHz, for example, less than 500 Hz. The frequency of the first cancellation signal may be less than 3 KHz, for example, less than 500 Hz. Adder 203 can be configured to couple the first cancellation signal and the first mixed audio signal to generate the echo-cancel audio signal. In some embodiments, the audio of interest signal is canceled out in the echo-cancel audio signal by adder 203.

Figure 5:
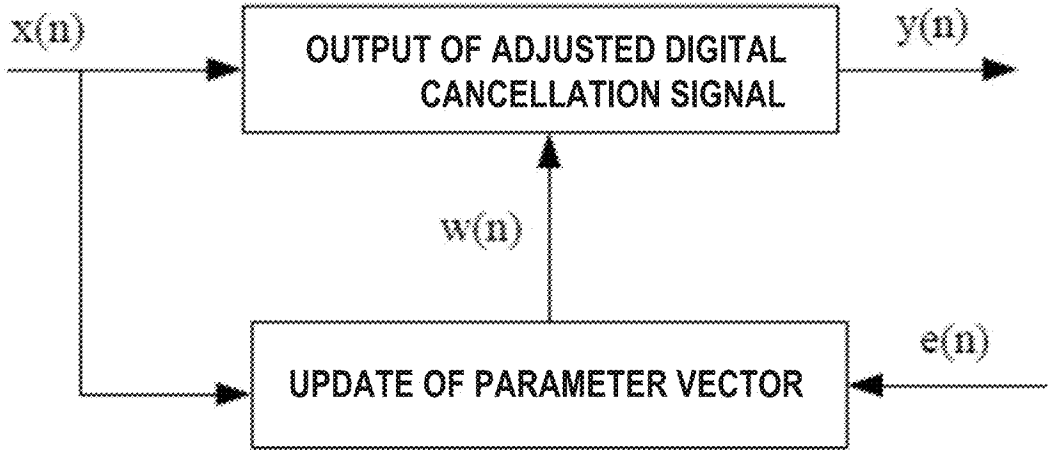
FIG. 5 illustrates an exemplary process of adaptively adjusting filtering parameters in accordance with an embodiment of the present disclosure.

In some embodiments, echo-cancel filter 202 may be a static filter or an adaptive filter. In some embodiments, echo-cancel filter 202 is a static filter, and the filtering parameters are preset static values. In some embodiments, echo-cancel filter 202 is an adaptive filter, which is configured to adaptively adjust one or more parameters associated with the filtering (filtering parameters) based on the output signal of echo-cancel module 207, e.g., the echo-cancel audio signal. For example, FIG. 5 illustrates an exemplary process of adaptively adjusting filtering parameters in accordance with an embodiment of the present disclosure. In some embodiments, as illustrated in FIG. 5, echo-cancel filter 202 is configured to adaptively adjust the filtering parameters based on the input signal of echo-cancel filter 202 as well, e.g., the first audio source signal from audio source 206. For example, a parameter vector of the filtering parameters w(n) may be updated based on the echo-cancel audio signal e(n) and the first audio source signal x(n) according to Equation (1) below:

$$w(n+1)=w(n)+2\mu e(n)\times(n) \quad (1),$$

where w(n+1) is the updated parameter vector, and μ is the step that is in the range of $0<\mu<2/MP_{in}$, where M is the length of echo-cancel filter 202, and $P_{in}=E[x^2(n)]$ is the input power of the first audio source signal x(n). The updated digital cancellation signal y(n) (e.g., the first cancellation signal) may be determined according to Equation (2) below:

$$y(n)=w^T(n)\times(n) \quad (2),$$

where $w^T(n)$ is the transpose vector of the parameter vector w(n).

In some embodiments, the parameters of echo-cancel filter 202 may be determined based on N pre-tested relationships between at least one of the system parameters (e.g., the transfer function or the energy of the environmental noise signal obtained by the internal microphone) and the parameters of echo-cancel filter 202 under different working scenarios. The current system parameters may be compared to the pre-tested system parameters of the N pre-tested results. The pre-tested parameters of echo-cancel filter 202 corresponding to the pre-tested system parameters most similar to the current system parameters can be determined as the parameters of echo-cancel filter 202 for generating the echo-cancel audio signal.

In some embodiments, the feedback loop may further include an ANC filter 204, operatively coupled to echo-cancel module 207. ANC filter 204 may be any suitable digital filters, such as an FIR filter, an IIR filter, or a combination of FIR and HR filters. In some embodiments, ANC filter 204 is configured to receive the echo-cancel audio signal from adder 203 and generate a first noise-cancel signal. In some embodiments, ANC filter 204 is sensitive to low-frequency signals, such as less than 3 KHz, for example, less than 500 Hz. The frequency of the first noise-cancel signal may be less than 3 KHz, for example, less than 500 Hz. ANC filter 204 may be a static filter or an adaptive filter. In some embodiments, ANC filter 204 is configured to reduce the gain thereof when the power of the echo-cancel audio signal is above a threshold, thereby improving the stability of the feedback loop.

In some embodiments, the feedback loop further includes a limiter 412 between ANC filter 204 and adder 440. Limiter 412 may be arranged before DAC 201 to perform the anti-saturation function to compress the amplitude of the signal, for example, by dynamic range compression (DRC) when it is above a threshold, thereby avoiding saturation of low-frequency noise, e.g., below 100 Hz. The low-frequency noise can be caused by, for example, motion (e.g., bumps on the road) and touching the microphones. The low-frequency noises can have relatively large amplitudes, which can cause saturation in the feedback loop, the feed forward loop, or both. For example, the limiter may have a first signal amplitude threshold T1, a second signal amplitude threshold T2, and a third signal amplitude threshold T3, which have values from small to large, respectively, in this order. When the amplitude of the input signal of the limiter is between the first and third signal amplitude thresholds T1 and T3, the amplitude of the output signal of the limiter may be compressed to a value between the first and second signal amplitude thresholds T1 and T2. When the amplitude of the input signal of the limiter is above the third signal amplitude threshold T3, the amplitude of the output signal of the limiter may be compressed to the second signal amplitude threshold T2. When the amplitude of the input signal of the limiter is below the first signal amplitude threshold T1, the limiter may not compress the amplitude of the input signal.

In some embodiments, the feed forward loop may be configured to perform either ANC or talk-through function (e.g., acting as the talk-through loop when including the talk-through module). When performing ANC function, environmental noises may be obtained by external microphone 107 outside the ear canal of the user when ANC headphone 100 is worn. External microphone 107 may obtain a second mixed audio signal including a noise signal based on the environmental noise. In some embodiments, the second mixed audio signal may be amplified (e.g., with a weight between 0-1) by the second amplifier 422. In some embodiments, the second mixed audio signal is an analog signal that can be converted by ADC 405 to a digital signal. In some embodiments, the digital signal may further be de-sampled by a de-sample filter/decimator 432. This may reduce the order of the filter and thus reduce the size of the functioning circuit of ANC headphone 100 and reduce the cost.

The feed forward loop may further include an ANC filter 403, operatively coupled to de-sample filter 432. ANC filter 403 may be any suitable digital filters, such as an FIR filter, an IIR filter, or a combination of FIR and IIR filters. In some embodiments, ANC filter 403 is configured to receive the processed second mixed audio signal from de-sample filter 432 and generate a second noise-cancel signal accordingly.

In some embodiment, a noise-controlled audio may be generated by adding the first audio source signal from audio source 206, the first noise-cancel signal generated by the feedback loop and/or the second noise-cancel signal generated by the feed forward loop using an adder 440. In some embodiment, a noise-controlled audio may be generated by adding the first noise-cancel signal generated by the feedback loop and the second noise-cancel signal generated by the feed forward loop using an adder 440. In some embodiment, a noise-controlled audio may be generated by the first noise-cancel signal generated by the feedback loop or the second noise-cancel signal generated by the feed forward loop. In some embodiments, the noise signal is canceled out in the noise-controlled audio source signal by adder 440 to generate a noise-controlled audio source signal. In some embodiments, the noise-controlled audio source signal is converted from a digital signal to an analog signal by DAC 201, which is then played by speaker 104.

In some embodiments, when performing the talk-through function, external microphone 107 may be configured to obtain a talk-through sound. In some embodiments, external microphone 107 obtains a mixed audio signal including the talk-through audio signal, a noise signal based on the environmental noise, and a leakage (e.g., the noise-controlled audio signal played by speaker 104 that leaked to the outside of the ear canal).

Similar to generating the second noise-cancel signal, the received mixed audio signal may pass second amplifier 422, ADC 405 and de-sampler filter 432 for similar processing purposes. Different from generating the second noise-cancel signal, the feed forward loop may further include a talk-through module 450. In some embodiments, talk-through module 450 may include an adder 456, a talk-through filter 452 and a de-leakage filter 454.

In some embodiments, de-leakage filter 454 may perform substantially the same functions as echo-cancel filter 202 and may be the same or different type of filter as echo-cancel filter 202. For example, de-leakage filter 454 may be configured to generate a de-leakage signal based on the noise-controlled audio signal (e.g., the audio signal added by adder 440, before converted by DAC 201) for canceling the leakage from the mixed audio signal. The de-leakage signal may be added to the mixed audio signal by adder 456 to generate a leakage canceled talk-through audio signal (e.g., by canceling out the leakage). In some embodiments, de-leakage filter 454 may adaptively update the filter parameters based on an input of de-leakage filter 454, similar to the process in which echo-cancel filter 202 adapts its' parameters. In some embodiments, the parameters of de-leakage filter 454 may also be determined based on N pre-tested relationships between at least one of the system parameters (e.g., the transfer function or the energy of the environmental noise signal obtained by the internal microphone) and the parameters of de-leakage filter 454 under different working scenarios, similar to the process for determining the parameters of echo-cancel filter 202.

In some embodiments, talk-through filter 452 is operatively connected to adder 456 and is configured to filter the noise from the talk-through audio signal. Talk-through filter 452 may be any suitable digital filters, such as an FIR filter, an IIR filter, or a combination of FIR and IIR filters. Talk-through filter 452 may filter noise signals (e.g., the environmental noise) to keep the talk-through sound in certain frequency ranges that the user is interested in. In some embodiments, talk-through filter 404 is sensitive to signals in a frequency range less than a frequency between 2 KHz and 30 KHz. The frequency of the filtered talk-through audio signal may be less than a frequency between 2 KHz and 30 KHz. Talk-through filter 452 may be configured to fit the inside noise signal to be as close to the environmental noise signal as possible based on properly adjusting the parameter of talk-through filter 452. In some embodiments, a limiter (not shown) is arranged between talk-through filter 452 and adder 440 to compress the amplitude of the filtered talk-through audio signal to avoid saturation. The limiter may be another example of the limiter described with respect to limiter 402. In some embodiment, DAC 201 may include an up-sampling filter such that the conversion may happen at a high frequency. For example, when adder 440 works at 384 kHz, DAC 201 may work at 384K×64=24.576 MHz.

In some embodiments, when the talk-through loop is operating either alone or in combination with the feedback loop, internal microphone 103 is configured to obtain a mixed audio signal including a noise signal and a second talk-through audio signal based on the audio played by speaker 104. The audio played may include talk-through sound based on the first talk-through audio signal obtained by external microphone 107, as well as environmental noises. Echo-cancel module 207 may be configured to reduce the second talk-through audio signal from the mixed audio signal based on the first talk-through audio signal to generate an echo-cancel audio signal. In some embodiments, the first talk-through audio signal is filtered by the feed forward loop, e.g., by talk-through filter 452 (and the limiter). In some embodiments, to reduce the second talk-through audio signal from the mixed audio signal, echo-cancel filter 202 is configured to filter the first talk-through audio signal to generate a first cancellation signal, and adder 203 is configured to couple the first cancellation signal and the mixed audio signal to generate the echo-cancel audio signal, according to some embodiments. As described above in detail, echo-cancel filter 202 may be configured to adaptively adjust a parameter associated with the filtering based on the echo-cancel audio signal. In some embodiments, ANC filter 204 is configured to filter the echo-cancel audio signal to generate the first cancellation signal, and adder 440 is configured to couple the second cancellation signal and the filtered first talk-through audio signal to generate the noise-controlled talk-through audio signal to be played by speaker 104.

In some embodiments, when both the feedback and feed forward loops work together for ANC, speaker 104 is configured to play the audio based on both the first audio source signal (e.g., a music signal, a prompt tone and/or a sub-audible reference tone), the first mixed audio signal obtained by internal microphone 103 that includes the second audio source signal together with the noise inside the ear canal, and the second mixed audio signal obtained by external microphone 107 that includes the noise outside the ear canal. In some embodiments, echo-cancel module 207 is further configured to reduce the second audio source signal within the first mixed audio signal based on the first audio source signal for generating the echo-cancel audio signal. In some embodiments, ANC filter 204 and ANC filter 403 are applied to reduce the noise signal from the first audio source signal through the feedback loop (e.g., based on the echo-cancel audio signal) and feed forward loop respectively.

In some embodiments, the amplification factor of first amplifier 420 and second amplifier 422 may be adjusted smoothly while switching/changing the value of the parameter. Still, during each time point of the adjusting process, the sum of the amplification factor of first amplifier 420 and second amplifier 422 keeps being 1.

In some embodiments, when updated filter function parameters are determined for better ANC performance (e.g., dynamically adjust the parameters of the filter function module), the ANC headphone may switch/adjust the filter function module from the current filter function parameters to the updated filter function parameters smoothly to avoid sudden change. For example, a first amplifier factor may be associated with the updated filter function parameters, and a second amplifier factor may be associated with the current filter function parameters. And the updated and the current filter function parameters are weighted according to the first and the second amplifier factor such that the sum of the first and the second amplifier factor equals to 1 at each time point (e.g., 0-1, 0.2-0.8, 0.5-0.5, 0.8-0.2, 1-0, etc.). Accordingly, the filter function module is switched/adjusted from the current filter function parameter to the updated filter function parameter by gradually adjusting the ration between the first amplifier factor and the second amplifier factor from 0-1 to 1-0.

Figure 6:
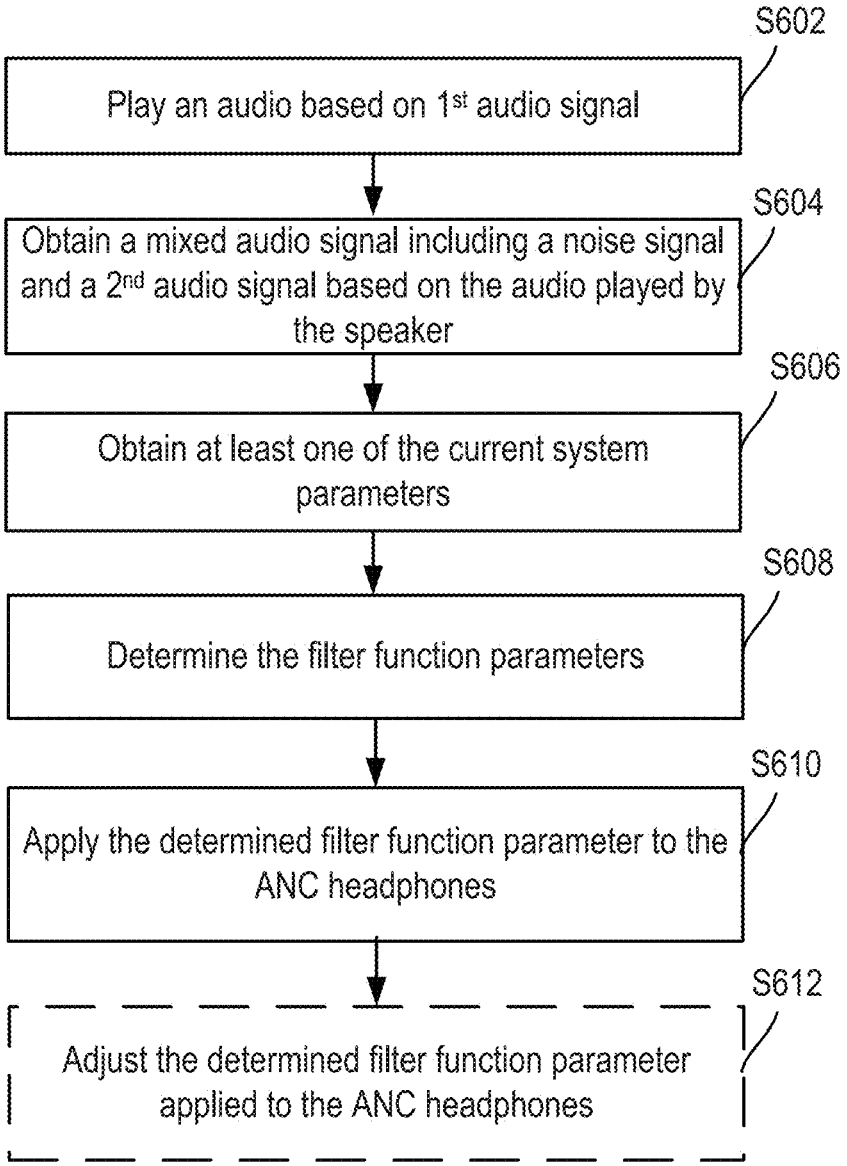
FIG. 6 is a flow chart illustrating an exemplary method for ANC in accordance with an embodiment of the present disclosure.

FIG. 6 is a flow chart illustrating an exemplary method 600 for ANC in accordance with an embodiment of the present disclosure. It is to be appreciated that not all operations may be needed to perform the disclosure provided herein. Further, some of the operations may be performed simultaneously, or in a different order than shown in FIG. 6, as will be understood by a person of ordinary skill in the art. Method 600 can be performed by ANC headphone 100. However, method 600 is not limited to that exemplary embodiment.

In step 602, an audio is played based on a first audio signal by a speaker (e.g., speaker 104). The first audio signal may be a music signal, a prompt tone audio signal, a sub-audible reference tone audio signal, or both music and prompt tone audio signals or sub-audible reference tone audio signals. In some embodiments, the audio is played by speaker 104. In some embodiments, the prompt tone audio signal is the notice tone such as "the ANC is on" or a "Ding" sound indicating the ANC is activated or indicating the headphone is put on by the user. The duration of the prompt tone played may be several seconds, such as less than five-second. In some embodiments, the sub-audible reference tone is outside the hearing range of a human being (e.g., lower than 20 Hz or higher than 20 kHz), such as 10 Hz, 15 Hz, etc. In some embodiments, when start to play the sub-audible reference tone, the amplitude of the sub-audible reference tone is increased gradually such that the user may not hear the noise caused by the low-frequency vibration of the sub-audible reference tone. Similarly, when stop playing the sub-audible reference tone, the amplitude of the sub-audible reference tone is decreased gradually as well.

At step 604, a mixed audio signal including a noise signal and a second audio signal based on the first audio signal played by the speaker is obtained by an internal microphone (e.g., internal microphone 103) disposed inside the ear canal of a user.

At step 606, at least one of the current system parameters of the ANC headphone is obtained (e.g., the system parameters corresponding to the filter function parameter to be determined). In some embodiments, the current system parameters may be the transfer function of the ANC headphone. In some other embodiments, the current system parameters may be parameters associated with the mixed audio signal obtained by the internal microphone such as the time domain distribution, the frequency domain distribution, energy in time and/or frequency domain, or any of the combination thereof. For example, when the current system parameter is the transfer function, it can be determined based on the obtained mixed audio signal and the first audio signal played by the speaker. For example, FIG. 7 is an exemplary process 700 for obtaining the transfer function in accordance with an embodiment of the present disclosure.

In some embodiments, when using the sub-audible reference tone as the audio of interest, and when the energy in time and/or frequency domain of the mixed audio signal is used as the current system parameters, the energy is normalized based on the energy of the audio signal played by speaker 104. In this, the interference brought by the difference of the amplitude of the audio signal played by speaker 104 can be avoided. Similarly, when the audio of interest include music or the talking sound, the audio of interest may be pre-processed (e.g., passing a low-pass filter or a peak filter) before being normalized. The low-pass filter or the peak filter filters out the music or the talking sound. And the sub-audible reference tone remains. In this, the interference brought by music or the talking sound played by speaker 104 can be avoided. When testing the energy in time and/or frequency domain of the mixed audio signal for obtaining pre-test data (e.g., N pair of system parameters and filter function parameters), which will be disclosed below, the same normalization method can be applied as well.

Figure 7:
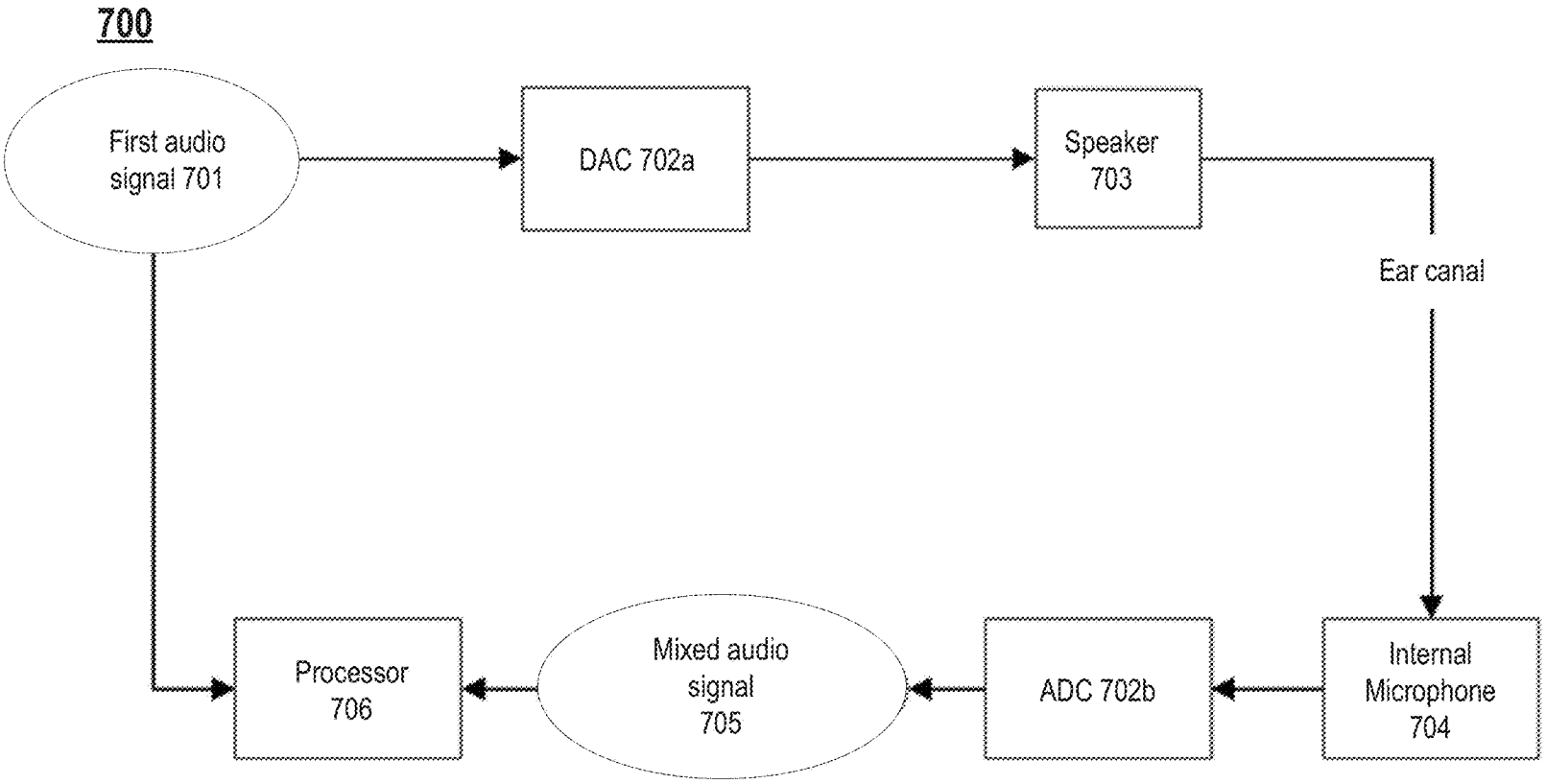
FIG. 7 is an exemplary process for obtaining the transfer function in accordance with an embodiment of the present disclosure.

As illustrated in FIG. 7, when the ANC headphone is wearing by the user, a first audio signal 701 is converted from a digital signal to an analog signal by a DAC 702*a* and played by a speaker 703. On the other hand, first audio signal 701 is also transmitted to a processor 706 (e.g., an echo-cancel module such as an echo-cancel module). The played audio signal is obtained by an internal microphone 704 inside the ear canal and is converted by an ADC 702*b* to a digital audio signal (e.g., mixed audio signal 705). Processor 706 receives mixed an audio signal 705 and can obtain the transfer function based on first audio signal 701 and mixed audio signal 705.

As illustrated in FIG. 7, pre-tested data (e.g., the filter function parameters and the system parameters) can be obtained. When the ANC headphone is wearing by the user in certain scenarios, or when the ANC headphone is put on an artificial ear in certain scenarios, a first audio signal 701 is converted from a digital signal to an analog signal by a DAC 702*a* and played by a speaker 703. On the other hand, first audio signal 701 is also transmitted to a processor 706 (e.g., an echo-cancel module such as an echo-cancel module). The played audio signal is obtained by an internal microphone 704 inside the ear canal and is converted by an ADC 702*b* to a digital audio signal (e.g., mixed audio signal 705). Processor 706 receives mixed an audio signal 705 and can obtain the transfer function based on first audio signal 701 and mixed audio signal 705. In this scenario, we also obtain the filter function parameters of the ANC headphone. In some embodiments, when obtaining the pre-tested data for preforming the ANC, the filter function parameters may be determined such that the inside noise received by the internal microphone or artificial ear microphone is minimized. The filter function parameters may be at least one of the first ANC filter coefficients and the second ANC filter coefficients. The filter function parameters can be adjusted until the inside noise received by the internal microphone or artificial ear microphone is minimized or reach a predefined value. The test or adjustment may be performed in advance, such as in the laboratory.

In some embodiments, when the filter function parameters are at least one of the echo-cancel filter coefficients, the filter function parameters may be determined to minimize or even remove the second audio source signal from the first mixed audio signal. In some embodiments, when the filter function parameters may be at least one of the de-leakage filters, the filter function parameters may be determined to minimize or even remove the leakage from the talk-through signal. When obtaining the pre-tested data for preforming the talk-through function, in this scenario, the filter function parameters may be determined such that the inside noise received by the internal microphone is the closest (e.g., ideally identical) to the environmental noise obtained by the external microphone or the artificial ear microphone. In some embodiments, the environmental noise is obtained by the internal microphone or the artificial ear microphone when the ANC headphone isn't wearing by the user and isn't put on the artificial ear. The filter function parameters may also be at least one of the talk-through filter coefficients. The determination or adjustment of the filter function parameters may be performed in advance, such as in the laboratory. So the system parameters and its corresponding filter function parameters may be obtained in this scenario. In this scenario, the system parameters can be paired with the determined filter function parameters to constitute a data point of pre-tested data 310. N different tests may be conducted to obtain N pairs of the filter function parameters and the system parameters in N different working scenarios. Then N pairs of pre-tested data are obtained.

In some embodiments, the filter function parameters may be the parameters of the equalization filter. In some embodiments, the equalization filter may include a fixed equalization filter and a variant equalization filter. To obtain the pre-tested data for the equalization filter parameter, the parameter of the fixed equalization filter EQtest1 and the parameter of the variant equalization filter EQtest2 may be determined. The parameter of the variant equalization filter EQtest2 may then be paired with the corresponding system parameter to constitute a data point of the pre-tested data (e.g., one of the N pairs of the pre-tested data, disclosed in detail below) for determining the current filter function parameters. The N pairs of the pre-tested data may be obtained under N different working scenarios.

For one example, when obtaining the pre-tested data for the equalization filter, the fixed equalization filter parameters may be determined as EQtest1 by an examiner. Then the system parameter Htest1 corresponding to EQtest1 may be obtained. In some embodiments, when the system parameter Htest1 being used is the transfer function of the ANC headphone (e.g., from the speaker to the internal microphone), a sub-audible reference tone or prompt tone may be used as the audio of interest for obtaining the transfer function. In some other embodiments, the energy in time and/or frequency domain of the mixed audio signal obtained by the internal microphone can also be used as the system parameters Htest1.

When determining the parameter of the variant equalization filter EQtest2, the system parameter Htest2 of the ANC headphone under another working scenario is obtained using a similar method disclosed above. Then, the variant equalization filter parameter EQtest2 may be determined based on Htest1, Htest2, and EQtest1. For example, EQtest2 may be determined based on EQtest2=EQtest1*Htest1*(1/Htest2). EQtest2 and Htest2 may be paired to form a data point of the pre-tested data. In some embodiments, N different tests (e.g., for obtaining EQtest2 to EQtestn) may be conducted under N different working scenarios. The results of the N different tests (e.g., EQtesti and Htesti, i=2, 3, 4 . . . N, N+1) can be used as the pre-tested data for determining the current equalization filter parameter of the ANC headphone.

In some embodiments, the equalization filter parameter may also be determined based on the inverse function of the transfer function of the ANC headphone. In this way, the equalization filter parameter parameters in the pre-tested data may be determined as EQtest1 by an examiner. The corresponding transfer function of the ANC headphone Htest1 (e.g., from the speaker to the internal microphone) may also be obtained during the test. When the user plays the audio of interest, the current transfer function of the ANC headphone Hcurrent (e.g., from the speaker to the internal microphone) can be obtained. The current equalization filter parameter EQtestcurrent may be determined based on the current transfer function Hcurrent, Htest1 and EQtest1. For example, the current equalization filter parameter may be determined as EQtest1*Htest1*(1/Hcurrent).

Referring back to FIG. 6, in step 608, the current filter function parameters of the ANC headphone are determined. In some embodiments, the current filter function parameters (e.g., the on/off and/or the filter coefficient of the first ANC filter (e.g., ANC filter 204) and the second ANC filter (e.g., ANC filter 403) and the echo cancel filter and the de-leakage filter may be determined based on the relationship between the filter function parameters and the system parameters. For example, FIGS. 8 and 9 are flow charts illustrating exemplary methods 800 and 900 for filter function parameters determination in accordance with embodiments of the present disclosure.

Figure 8:
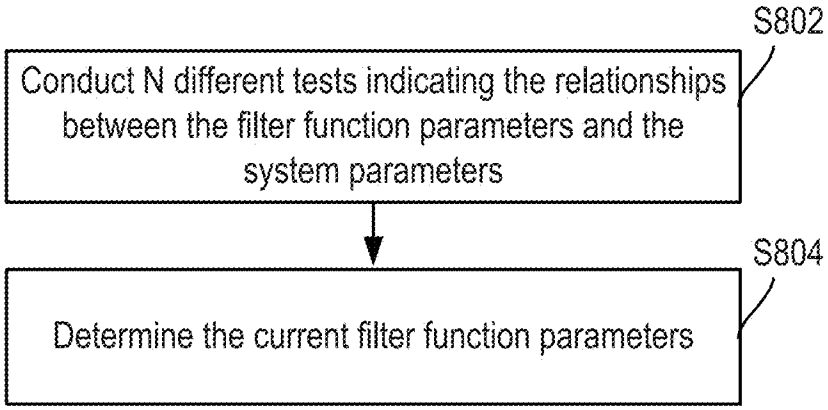
FIGS. 8 and 9 are flow charts illustrating exemplary methods for filter function parameters determination in accordance with embodiments of the present disclosure.
Figure 9:
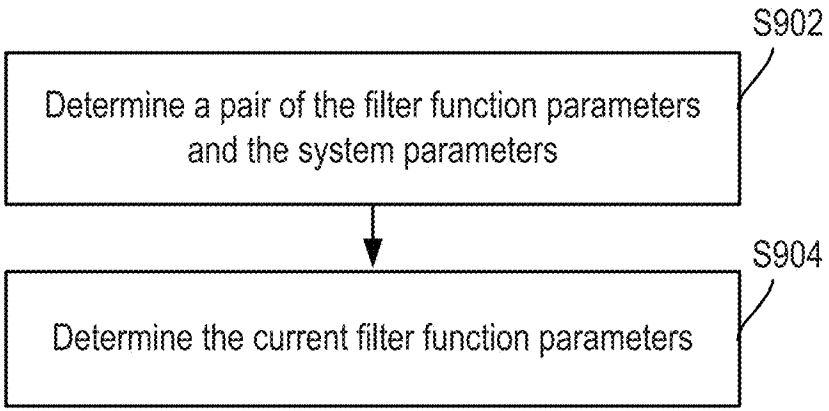

In one embodiment, as illustrated in FIG. 8, the current filter function parameters may be determined based on the relationship determined using pre-tested data (e.g., conducting N different tests revealing the relationships between the filter function parameters and the system parameters in different working scenarios).

In step 802, N different tests may be conducted indicating the relationships between the filter function parameters and the system parameters in different working scenarios. In some embodiments, the different working scenarios may include different canal structures, wearing manners, ANC headphones' conditions, parameters associated with the components within the ANC headphones, whether the ANC headphone is worn by the user or any of the combination thereof. For example, N pairs of the tested system parameters $H_1$ and the tested filter function parameters $H_2$ may be acquired under different testing environments (e.g., simulating the different working scenarios of the ANC headphones). The system parameters may be tested based on methods similar to the method for obtaining the current system parameter (e.g., process 700 illustrated in FIG. 7).

In step 804, the current filter function parameters $H_2'$ (e.g., the filter function parameters to be determined) are determined based on the Npairs of the tested system parameters $H_1$ and the tested filter function parameters $H_2$, and current system parameters $H_1'$ acquired at step 606. For example, the tested filter function parameters $H_2$ corresponding to the tested system parameters $H_1$ that are most similar to current system parameters $H_1'$ may be determined as the current filter function parameters $H_2'$ for the ANC headphones.

For example, when the current system parameter being used is the transfer function, the similarity between the tested system parameters $H_1$ and the current system parameters $H_1'$ may be determined based on comparing the amplitude, the phase, the energy, the gain, etc. of the tested system parameters $H_1$ and the current system parameters $H_1'$. The tested filter function parameters $H_2$ corresponding to the tested system parameters $H_1$ may then be determined as the current filter function parameters $H_2'$.

For another example, when the current system parameter being used is one of the audio parameters of the mixed audio signal received by the internal microphone, the similarity between the tested system parameters $H_1$ and the current system parameters $H_1'$ may be determined based on comparing the parameters of the mixed audio signal such as the time domain distribution, the frequency domain distribution, energy in time and/or frequency domain, or any of the combination thereof. The tested filter function parameters $H_2$ corresponding to the tested system parameters $H_1$ may then be determined as the current filter function parameters $H_2'$, similar to the example where the current system parameter being used is the transfer function.

In some other embodiments, as illustrated in FIG. 9, the current filter function parameters may be determined based on the relationship that $H_1*H_2=H_1'*H_2'$, where * stands for the convolution of the filter function parameters and the system parameters. For example, the differences between $H_1*H_2$ and any $H_1'*H_2'$ may be less than 1 dB (e.g., when the first audio being played has a frequency less than 2 k HZ) and thus may be approximately considered to be equal for filter function parameters determination purposes. In other words, in this embodiment, the convolutions of the current system parameters $H_1'$ and the current filter function parameters $H_2'$ under different working scenarios may be considered to be a constant.

In step 902, instead of acquiring N pairs of the tested system parameters $H_1$ and the tested filter function parameters $H_2$ in different working scenarios, only one pair of the tested system parameters $H_1$ and the tested filter function parameters $H_2$ needs to be acquired under one of the possible working scenarios. Only one scenario is needed to obtain this pair of $H_1$ and $H_2$. In some embodiments, in this scenario, the headphone should be worn by the used or put on the artificial ear in any suitable manner.

In step 904, the current filter function parameters $H_2'$ may be determined based on the pair of the tested system parameters $H_1$ and the tested filter function parameters $H_2$, and the current system parameters $H_1'$ acquired at step 606 according to the relationship $H_1*H_2=H_1'*H_2'$.

Referring back to FIG. 6, in step 610, the determined filter function parameters (e.g., the current filter function parameters) are applied to the ANC headphones by a processor to generate a noise-controlled audio signal for the speaker to play.

In some embodiments, when the first audio signal being played by the speaker is a sub-audible reference tone, it can be played periodically during the use of the ANC headphones to adapt the ANC headphones to working scenario changes. For example, the sub-audible reference tone may be played in every 2-seconds and for a 100-millisecond duration. It is contemplated that the interval and the duration of the periodically played sub-audible reference tone is not limited to the example disclosed herein. Other intervals and durations may be applied for better adaptability and ANC performance. The repetition of playing the sub-audible reference tone can provide the ANC headphones with more adaptability, such as switching the filter function parameters periodically to adapt to the environment changes while working. The intervals between the sub-audible reference tones can save the power consumption of the ANC headphones.

In step 612, current filter function parameters may optionally be adjusted if the difference between the two consecutive determined current system parameters is larger than a predetermined threshold. In some embodiments, the system parameters may be obtained at each time the prompt tone or the sub-audible reference tone is played. If the difference between the current system parameters and the system parameters obtained at the last play of the prompt tone or the sub-audible reference tone is larger than a predetermined threshold, the current filter function parameters corresponding to the current system parameters may be determined using at least one of the determination methods disclosed herein, and the filter function parameters may be adjusted to the determined filter function parameters. Otherwise (e.g., if the difference is no larger than the predetermined threshold), the ANC headphones can be considered as working in a stable condition, and no adjustment is needed. Thus, the current filter function parameters are adjusted only when the change of the working scenario of the ANC headphones is significant enough. This can reduce the computing power consumption of the ANC headphones.

In some embodiments, when the change in the working scenario of the ANC headphones is significant enough (e.g., the difference between the two consecutive determined current system parameters is larger than the predetermined threshold), the prompt tone or the sub-audible reference tone may also be adjusted to improve the robustness. For example, the amplitude and/or the duration of the played prompt tone, or the sub-audible reference tone may be increased. This can increase the robustness of the first audio signal to be played by the speaker against environmental interferences.

In some embodiments, the ANC headphone may also be configured to perform the talk-through function. For example, both the feedback and talk-through loops can work together, such that speaker 104 is configured to play the audio based on both the first audio source signal (e.g., music signal, the prompt tone and/or the sub-audible reference tone) and the first talk-through audio signal. In some embodiments, ANC filter 204 may be applied to reduce the noise signal from the mixed audio signal obtained by internal microphone 103 based on an echo-cancel module (e.g., echo-cancel module 207) for reducing a second audio source signal, similar to the process disclosed above and will not be disclosed in detail again. In some embodiments, talk-through filter 452 is configured to reduce the noise signal from the talk-through audio signal. In some embodiments, a de-leakage filter (e.g., an echo-cancel filter) is further configured to reduce a leakage (e.g., the audio signal played by the speaker that leaked out of the ear canal) from the talk-through signal.

Figure 10:
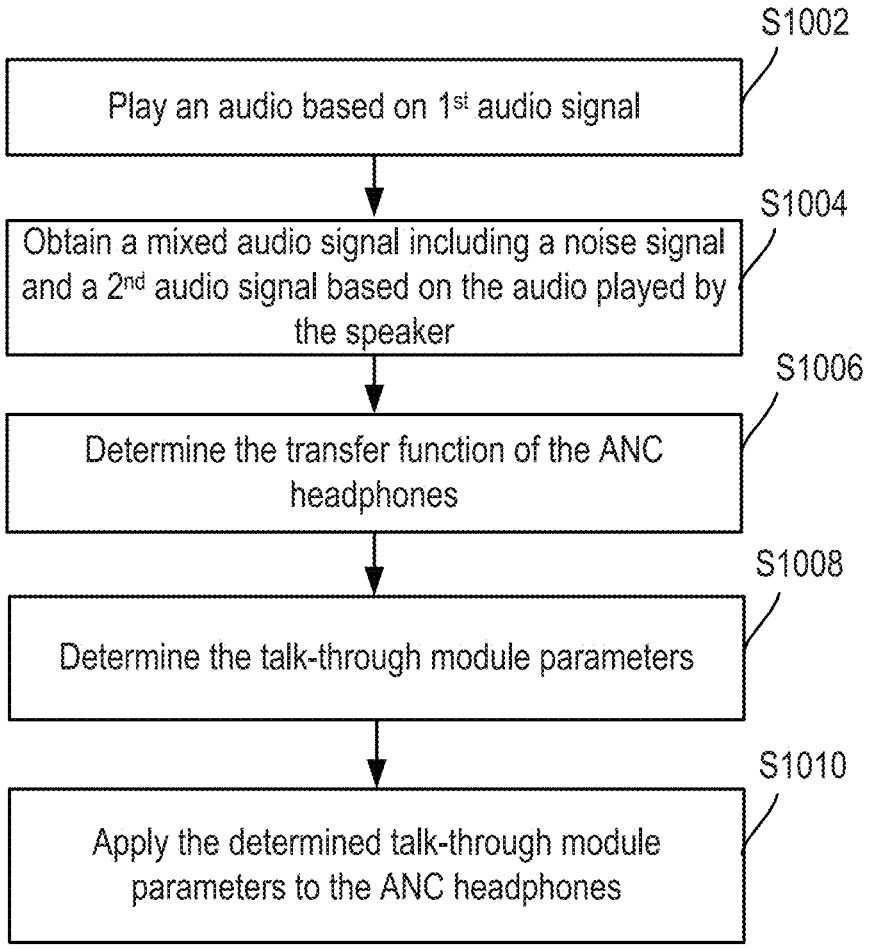
FIG. 10 is a flow chart illustrating an exemplary method for talk-through in accordance with an embodiment of the present disclosure.

FIG. 10 is a flow chart illustrating an exemplary method 1000 for talk-through in accordance with an embodiment of the present disclosure. It is to be appreciated that not all operations may be needed to perform the disclosure provided herein. Further, some of the operations may be performed simultaneously, or in a different order than shown in FIG. 10, as will be understood by a person of ordinary skill in the art. Method 1000 can be performed by ANC headphone 100. However, method 1000 is not limited to that exemplary embodiment.

In step 1002, an audio is played based on a first audio signal by a speaker (e.g., speaker 104). The first audio signal may be a music signal, a prompt tone, a sub-audible reference tone, or any of the combination thereof, similar to the first audio signal played in method 600.

At step 1004, a mixed audio signal including a noise signal and a second audio signal based on the first audio signal is obtained by an internal microphone (e.g., internal microphone 103) disposed inside the ear canal of a user.

At step 1006, the current transfer function of the ANC headphones (e.g., from the speaker to the internal microphone) is acquired. In some embodiments, the current transfer function is obtained based on the first audio signal and the mixed audio signal, similar to the process illustrated in FIG. 7 and will not be repeated in detail.

In step 1008, current parameters of a talk-through module (e.g., talk-through filter 452 and/or second amplifier 422) of the ANC headphone is determined. In some embodiments, the current talk-through module parameters (e.g., the filter coefficient of the talk-through filter, the amplification factor of the amplifier (e.g., second amplifier 422), etc.) may be determined based on the relationship between talk-through module parameters and the transfer function of the ANC headphones. For example, FIG. 11 is a flow chart illustrating an exemplary method 1100 for determining the talk-through module parameters in accordance with an embodiment of the present disclosure.

Figure 11:
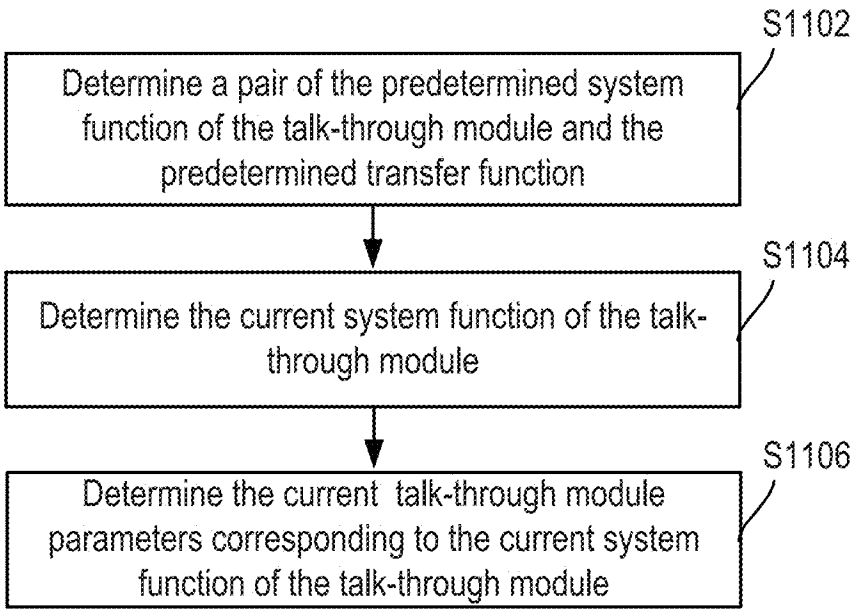
FIG. 11 is a flow chart illustrating an exemplary method for determining the talk-through module parameters in accordance with an embodiment of the present disclosure.

In some embodiments, as illustrated in FIG. 11, the current talk-through module parameters may be determined based on the relationship that $F_1(z)*H_1(z)=F_2(z)*H_2(z)$, where $F_1(z)$ stands for the predetermined the system function of the talk-through module corresponding to the predetermined talk-through module parameters, $H_1(z)$ stands for the predetermined transfer function corresponding to the predetermined the system function of the talk-through module, and * stands for the convolution of the system function of the talk-through module and the transfer function. For example, the differences between $F_1(z)*H_1(z)$ and $F_2(z)*H_2(z)$ may be less than 1 db (e.g., when the first audio signal being played has a frequency less than 2 k HZ) and thus may be approximately considered to be equal for talk-through module parameters determination purposes. In other words, in this embodiment, the convolutions of the current transfer function $H_2$ and the current system function of the talk-through module $F_2(z)$under different working scenarios may be considered to be a constant. The current system function $F_2(z)$ may be determined based on the current transfer function $H_2$ obtained at step 1006 along with the pair of the predetermined system function of the talk-through module $F_1(z)$ and the predetermined transfer function $H_1(z)$. The talk-through module parameters corresponding to the current system function of the talk-through module $F_2(z)$ may be determined as the talk-through module parameters for adjusting the talk-through module.

For example, in step 1102, a pair of the predetermined system function of the talk-through module $F_1(z)$ and the predetermined/corresponding transfer function $H_1(z)$ may be acquired by testing. In some embodiments, the pre-tested system function of the talk-through module $F_1(z)$ corresponding to the pre-tested talk-through module parameters may be determined based on the environmental noise received by the external microphone and the inside noise received by the internal microphone. The test may be conducted on an artificial ear (e.g., the ANC headphones are plugged into the artificial ear canal).

For example, when using the environmental noise and the inside noise for determining the talk-through module $F_1(z)$, the environmental noise may be detected by the internal microphone before the ANC headphones being plugged into the artificial ear canal. The noise inside the artificial ear canal may be detected by the internal microphone or the artificial ear microphone when the ANC headphones being plugged into the artificial ear canal. The predetermined talk-through module parameters may be determined based on adjusting the talk-through module parameters such that the noise inside the artificial ear is as close to the environmental noise as possible. In some embodiments, the predetermined talk-through module parameters may be determined based on multiple tests under different working scenarios (e.g., being exposed to different environmental noises), and may be the talk-through module parameters that can provide the best talk-through performance under different working scenarios. The system function corresponding to the predetermined talk-through module parameters may be determined as the predetermined system function $F_1(z)$.

Figure 12A:
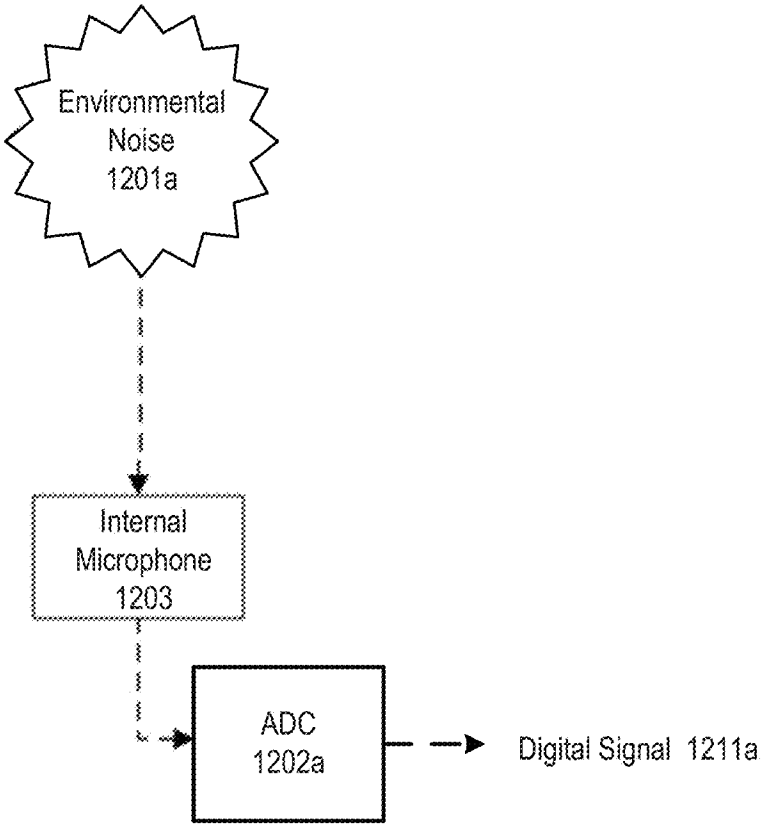
FIG. 12A illustrates an exemplary case when an ANC headphone is not plugged into a user's ear canal in accordance with an embodiment of the present disclosure.

For example, FIG. 12A illustrates an exemplary case when an ANC headphone is not plugged into a user's ear canal in accordance with an embodiment of the present disclosure. As illustrated in FIG. 12A, when the ANC headphone is not plugged into the user's ear canal, an internal microphone 1203 can be used to obtain environmental noise 1201*a*. Environmental noise 1201*a* can be digitalized into a first digital signal 1211*a* through ADC 1202*a*.

Figure 12B:
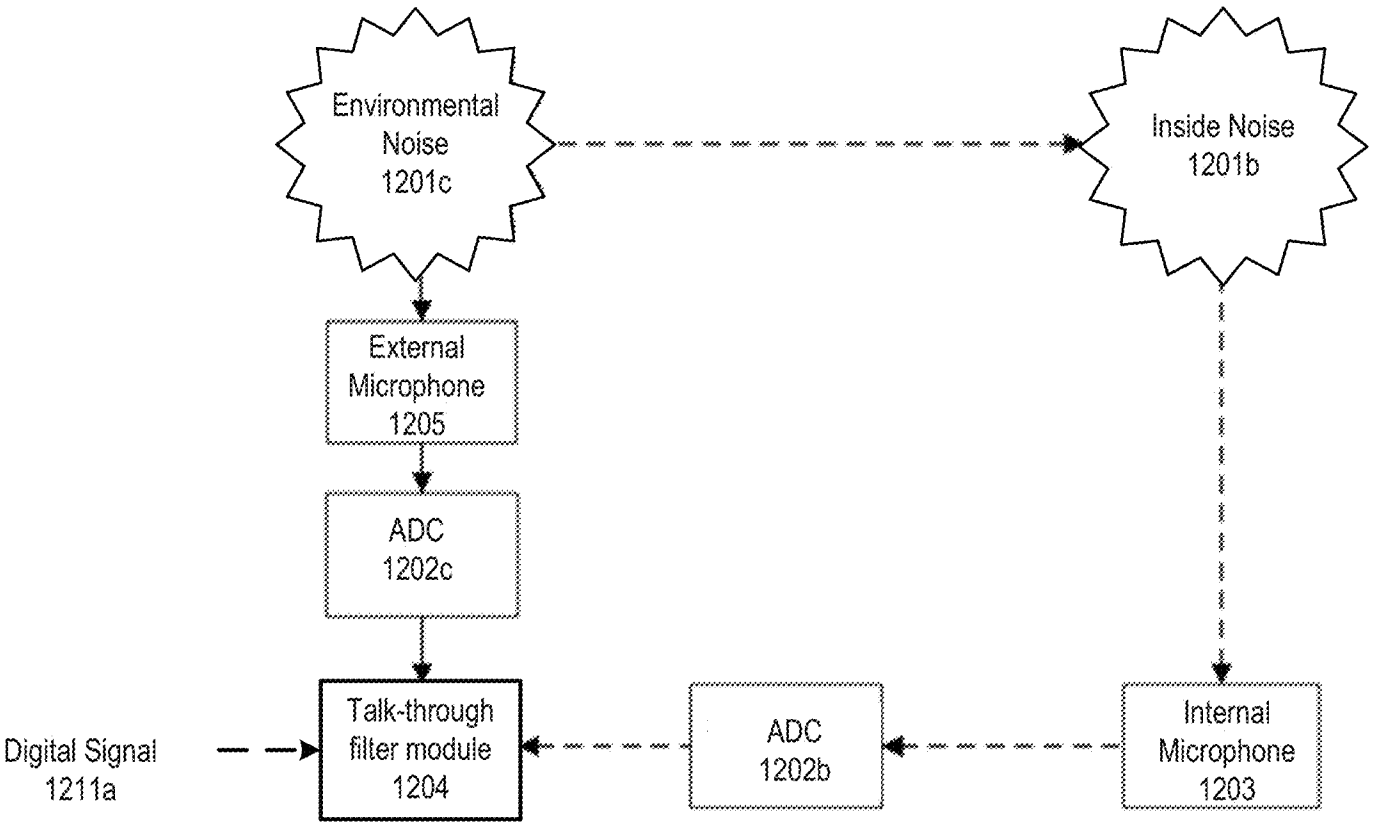
FIG. 12B illustrates an exemplary case when the ANC headphone of FIG. 12A is plugged into the user's ear canal and an exemplary process for determining the talk-through module parameters in accordance with an embodiment of the present disclosure.

FIG. 12B illustrates an exemplary case when the ANC headphone of FIG. 12A is plugged into the user's ear canal and an exemplary process for determining the talk-through module parameters in accordance with an embodiment of the present disclosure. When plugging the ANC headphones into the user's ear canal, internal microphone 1205 can be used to obtain the environmental noise (e.g., obtain environmental noise 1201*c*). Environmental noise 1201*c* can be converted into a second digital signal by ADC 1202*c* and be transmitted to talk-through filter module 1204 and be played by a speaker (not shown). Meanwhile, when the ANC headphone is being plugged-in, internal microphone 1203 can be used to obtain the noise inside the ear canal (e.g., inside noise 1201*b*). The talk-through module parameters can be determined based on the environmental noise obtained by internal microphone 1203 before being plugged-in (e.g., first digital signal 1211*a* which is converted from environmental noise 1201*a*) and the noise inside the ear canal obtained by internal microphone 1103 after being plugged-in (e.g., inside noise 1201*b*) such that inside noise 1201*b* could be as close to environmental noise 1201*a* as possible.

In some embodiments, the predetermined transfer function $H_1(z)$ may be determined based on a first audio signal played by the speaker and a second audio signal based on the first audio signal, received by the internal microphone, similar to the process illustrated in FIG. 7 and will not be repeated in detail.

In step 1104, the current system function of the talk-through module $F_2(z)$ may be determined based on the current transfer function $H_2$ obtained at step 1006 and the pair of the predetermined system function of the talk-through module $F_1(z)$ and the predetermined transfer function $H_1(z)$. For example, $F_2(z)$ may be determined based on $F_2(z)=F_1(z)*H_1(z)*(1/H_2(z))$.

In step 1106, the talk-through module parameters corresponding to the current system function $F_2(z)$ may be determined as the current talk-through module parameters for adjusting the talk-through module.

Referring back to FIG. 10, in step 1010, the determined current talk-through module parameters are applied to the ANC headphone by a processor to generate a talk-through audio signal for the speaker to play.

In some embodiments, method 1000 may further include using an echo-cancel model (e.g., a de-leakage filter 454) for filtering the leakage from the talk-through signal such that the audio signal of interest to be played will not be affected by the leakage included in the talk-through signal (e.g., reinforced by the leakage if not being eliminated). In some embodiments, the de-leakage filter may be a static filter or an adaptive filter, performing substantially the same function as echo-cancel module 207. In some embodiments, the parameters of the de-leakage filter may be determined based on N pre-tested relationships between at least one of the system parameters (e.g., the energy of the environmental noise signal obtained by the internal microphone) and the de-leakage filter parameters under different working scenarios. The current system parameters may be compared to the pre-tested system parameters of the N pre-tested results. The pre-tested de-leakage filter parameters corresponding to the pre-tested system parameters most similar to the current system parameters can be determined as the de-leakage filter parameters for performing the cancel function.

In some embodiments, method 1000 may further include using an echo-cancel model for filtering the second audio signal to realize the feedback ANC, similar to the process of using echo-cancel module 207. For example, FIG. 13 is an exemplary process of feedback ANC using an echo-cancel model in accordance with an embodiment of the present disclosure.

Figure 13:
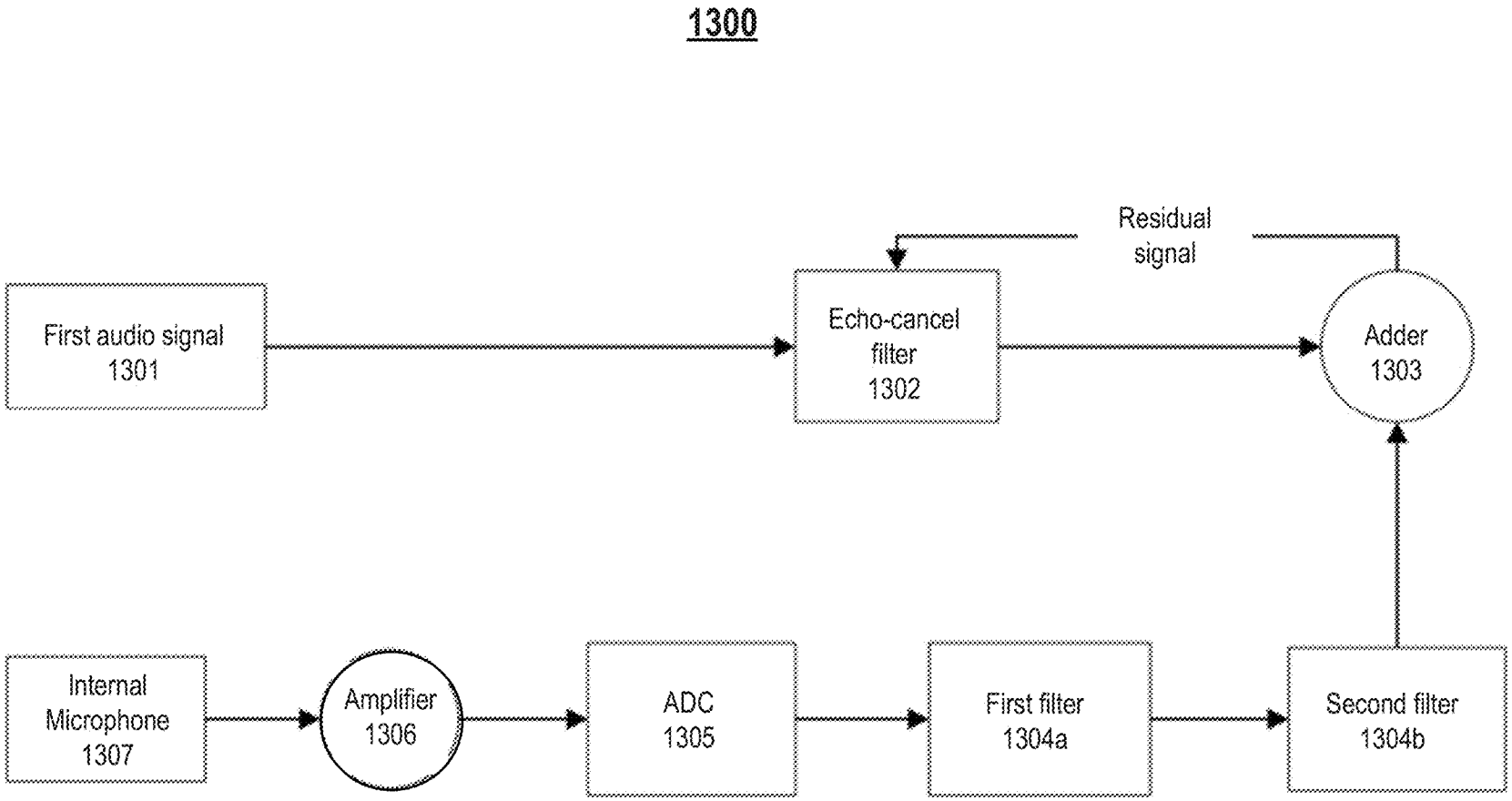
FIG. 13 is an exemplary process of feedback ANC using an echo-cancel model in accordance with an embodiment of the present disclosure.

As illustrated in FIG. 13, on one hand, an echo-cancel filter 1302 filters a first audio signal to be played by a speaker (not shown), and the filtered first audio signal is transmitted to an adder 1303. On the other hand, an internal microphone 1307 obtains a second audio signal (e.g., the audio signal obtained inside the user's ear canal). The second audio signal is amplified by an amplifier 1306 and be converted into a digital signal by an ADC 1305. The second audio signal is then be filtered by a first filter 1304*a* and a second filter 1304*b*, and be transmitted to adder 1303. In some embodiments, first filter 1304*a* and second filter 1304*b* can be low pass de-sampling filters/decimators. Adder 1303 can add the echo-cancel filtered first audio signal and the processed second audio signal such that the two signals can cancel each other. In some embodiments, the residual signal (e.g., the signal that failed to be canceled) can be transmitted back to echo-cancel filter 1302 for further improving the ANC performance. As a result, echo-cancel filter 1302 can reduce/eliminate the audio of interest (e.g., the audio signal being played by the speaker such as first audio signal 1301) from the cancel signal, and eliminate the impact of ANC on audio signals other than the noise signal, thereby improving the user experience.

Figure 14:
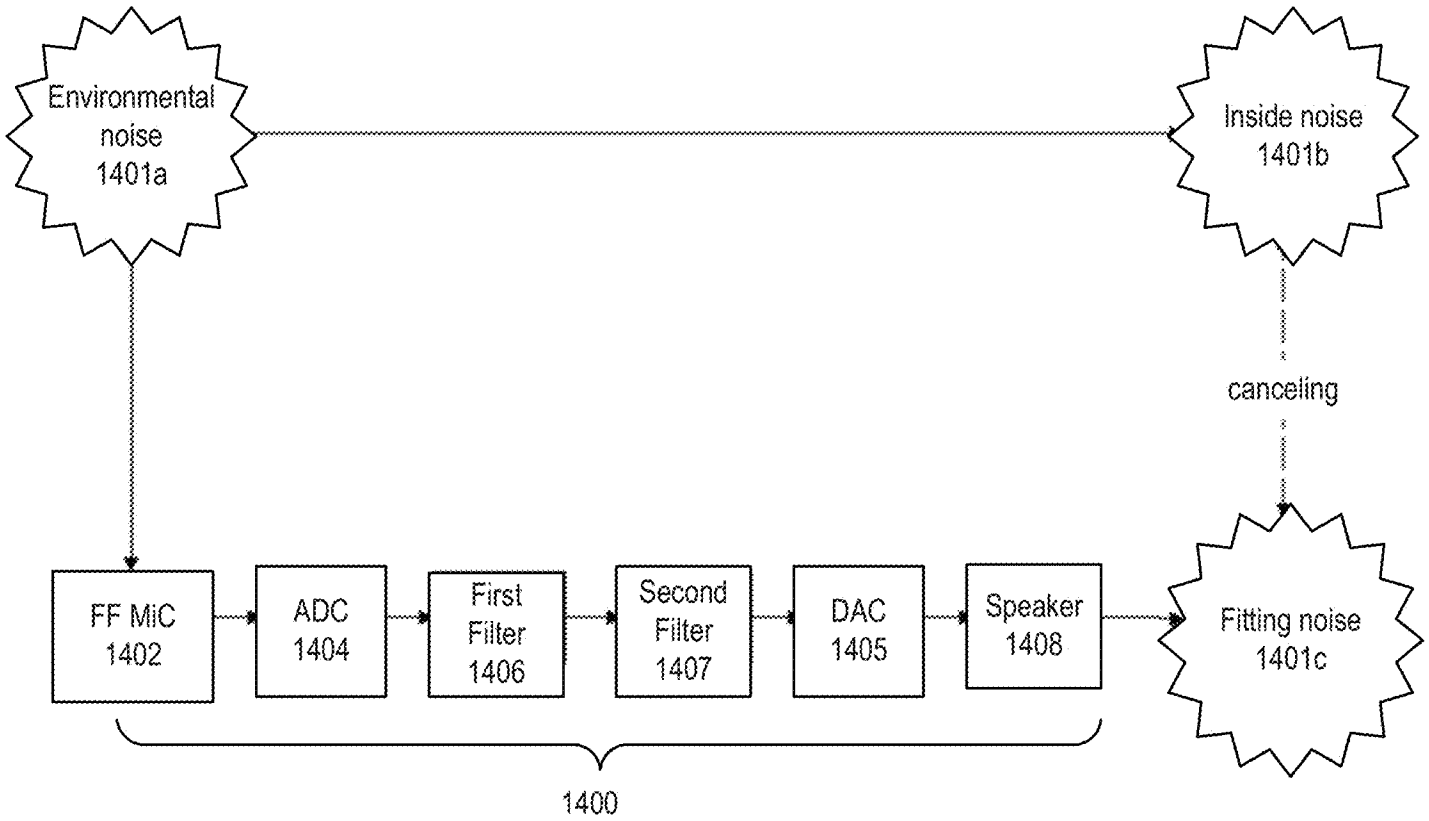
FIG. 14 is an exemplary process for adaptively adjusting filtering parameters in accordance with an embodiment of the present disclosure.

In some embodiments, the ANC headphone performs the ANC function based on a first filter module configured to fit the system function and a second filter module configured to fit the calibration function for balancing the coefficient of the filter. FIG. 14 is an exemplary process for adaptively adjusting filtering parameters in accordance with an embodiment of the present disclosure.

As illustrated in FIG. 14, an ANC headphone 1400 may perform ANC in an environment with an environmental noise 1401*a* (e.g., the noise around the user while using ANC headphone 1400). When wearing ANC headphone 1400, inside noise 1401*b* may be the noise received by an internal microphone (e.g., disposed inside the ear canal of the user). In some embodiments, inside noise 1401*b* may have lower intensity than environmental noise 1401*a* because of the blocking effect of the ear and ANC headphone 1400.

In some embodiments, ANC headphone 1400 includes, among other components, an external microphone 1402, a first filter 1406, a second filter 1407, a speaker 1408, an ADC 1404, and a DAC 1405. In some embodiments, environmental noise 1401*a* may be obtained by external microphone 1402 and be converted into an environmental noise signal by ADC 1404. The environmental noise signal may then be filtered/fitted by first filter 1406 and second filter 1407, respectively, and may be converted by DAC 1405 to generate a fitting noise 1401*c* played by speaker 1408. Fitting noise 1401*c* may be exactly or approximately the opposite to inside noise 1401*b* such that when being played by speaker 1408, fitting noise 1401*c* may cancel inside noise 1401*b*.

In some embodiments, when performing the ANC function, first filter 1406 may be configured to fit the transfer function of ANC headphone 1400 while second filter 1407 may be configured to adaptively fit the balancing part of the calibration function for the filter coefficient. When the working environment changes (e.g., with different canal structures, wearing manners, ANC headphones' conditions, parameters associated with the components within the ANC headphones, etc.), first filter 1406 may keep fitting the transfer function of ANC headphone 1400 while second filter 1407 may adaptively adjust the balancing part of the calibration function for the filter coefficient for better ANC performance.

In some embodiments, first filter 1406 may further be configured to fit the inverse function of the system function of external microphone 1402 to cancel the effect of external microphone 1402 imposed on the system (e.g., the effect imposed by obtaining and transmitting environmental noise 1401*a*). Similarly, second filter 1407 may further be configured to fit the inverse function of the system function of speaker 1408 to cancel the effect of speaker 1408 imposed on the system (e.g., the effect imposed by playing fitting noise 1401*c*).

Figure 15:
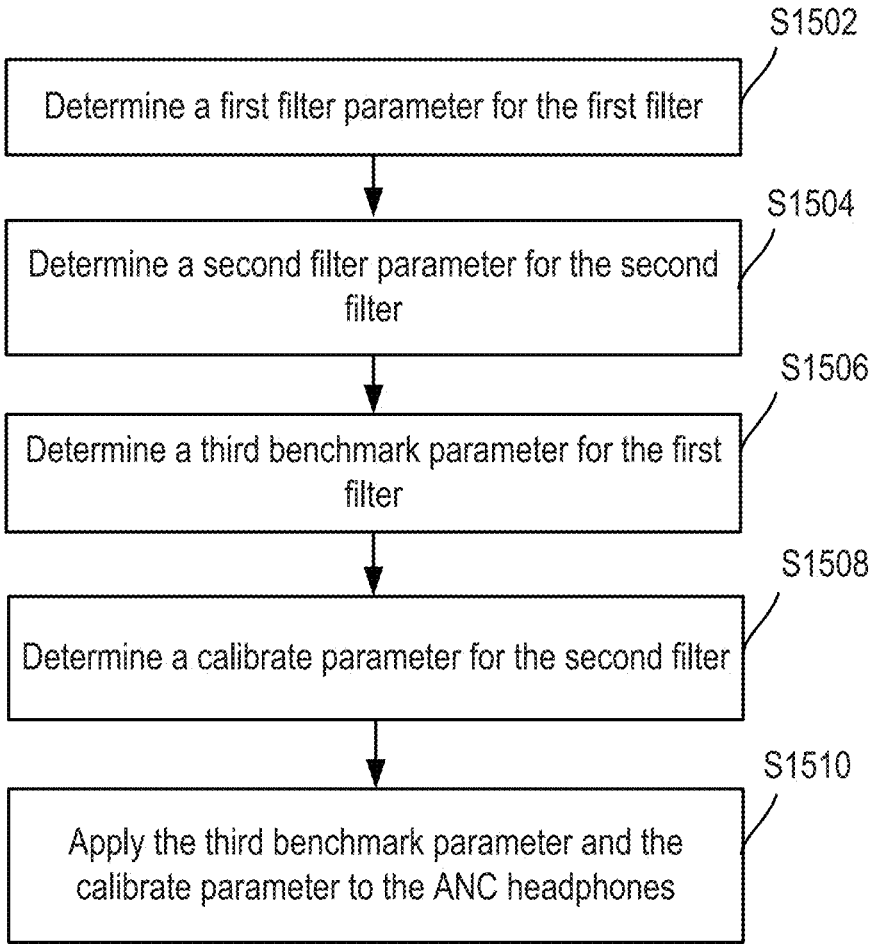
FIG. 15 is a flow chart illustrating an exemplary method for ANC in accordance with an embodiment of the present disclosure.

For example, FIG. 15 is a flow chart illustrating an exemplary method 1500 for ANC in accordance with an embodiment of the present disclosure. It is to be appreciated that not all operations may be needed to perform the disclosure provided herein. Further, some of the operations may be performed simultaneously, or in a different order than shown in FIG. 15, as will be understood by a person of ordinary skill in the art. Method 1500 can be performed by ANC headphone 1400. However, method 1500 is not limited to that exemplary embodiment.

Figure 16:
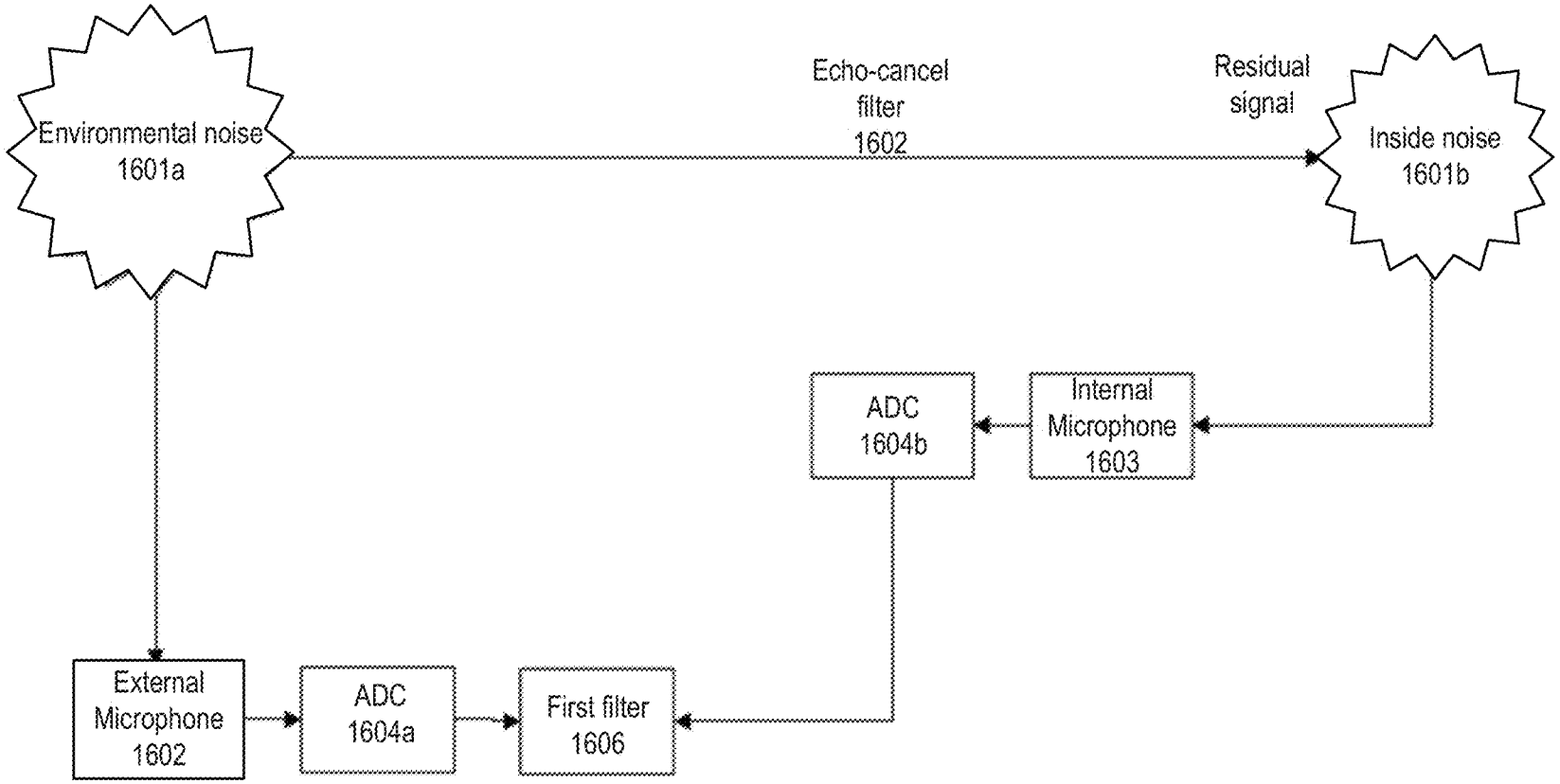
FIG. 16 is an exemplary process for determining the first parameter of a first filter in accordance with an embodiment of the present disclosure.

In step 1502, a first parameter of first filter 1406 may be determined based on environment noise 1401*a* and inside noise 1401*b*. For example, FIG. 16 is an exemplary process for determining the first parameter of a first filter (e.g., first filter 1406) in accordance with an embodiment of the present disclosure. As illustrated in FIG. 16, an external microphone 1602 obtains an environmental noise 1601*a*, which is converted into a digital signal by an ADC 1604*a* and is transmitted to a first filter 1606. An internal microphone 1603 obtains an inside noise 1601*b*, which is converted to a digital signal by an ADC 1604*b* and is transmitted to first filter 1606. The first parameter of first filter 1606 can be determined based on environmental noise 1601*a* and inside noise 1601*b*.

For example, the first parameter may be determined based on equation (3)

$$w(n+1) = w(n) + \mu \frac{Z(n)r(n)}{Z^T(n)Z(n)}, \tag{3}$$

where $w(n)=[w_0(n), w_1(n), w_2(n), \ldots, w_{L-1}(n)]^T$, L is the length of the first filter, n is the time point that the sample is taken, d(n) is the inside noise signal generated based on the environmental noise (e.g., passing through the ANC headphones), r(n) is the residual noise signal, determined based on $r(n)=d(n)-w^T(n)Z(n)$. μ is the iterative length of stride.

In some embodiments, as illustrated above, the first filter is further configured to fit the inverse function of the system function of the external microphone to cancel the effect of the external microphone imposed on the system (e.g., the effect on obtaining and transmitting environmental noise 1601*a*). Accordingly, the first parameter can be determined based on obtaining the environmental noise (e.g., environmental noise 1601*a*) and the inside noise (e.g., inside noise 1601*b*).

Referring back to FIG. 15, in step 1504, a second parameter of second filter 1408 may be determined based on a first audio signal played by speaker 1408 and a second audio signal obtained by the internal microphone inside the ear canal. In some embodiments, because the intensity of the environmental noise is not enough which can lead to a lack of robustness of the ANC system, the first audio signal (e.g., music, a prompt tone, a sub-audible reference tone, etc.) with an intensity larger than the environmental noise is used for determining the second parameter. This may increase the precision of the determination.

Figure 17:
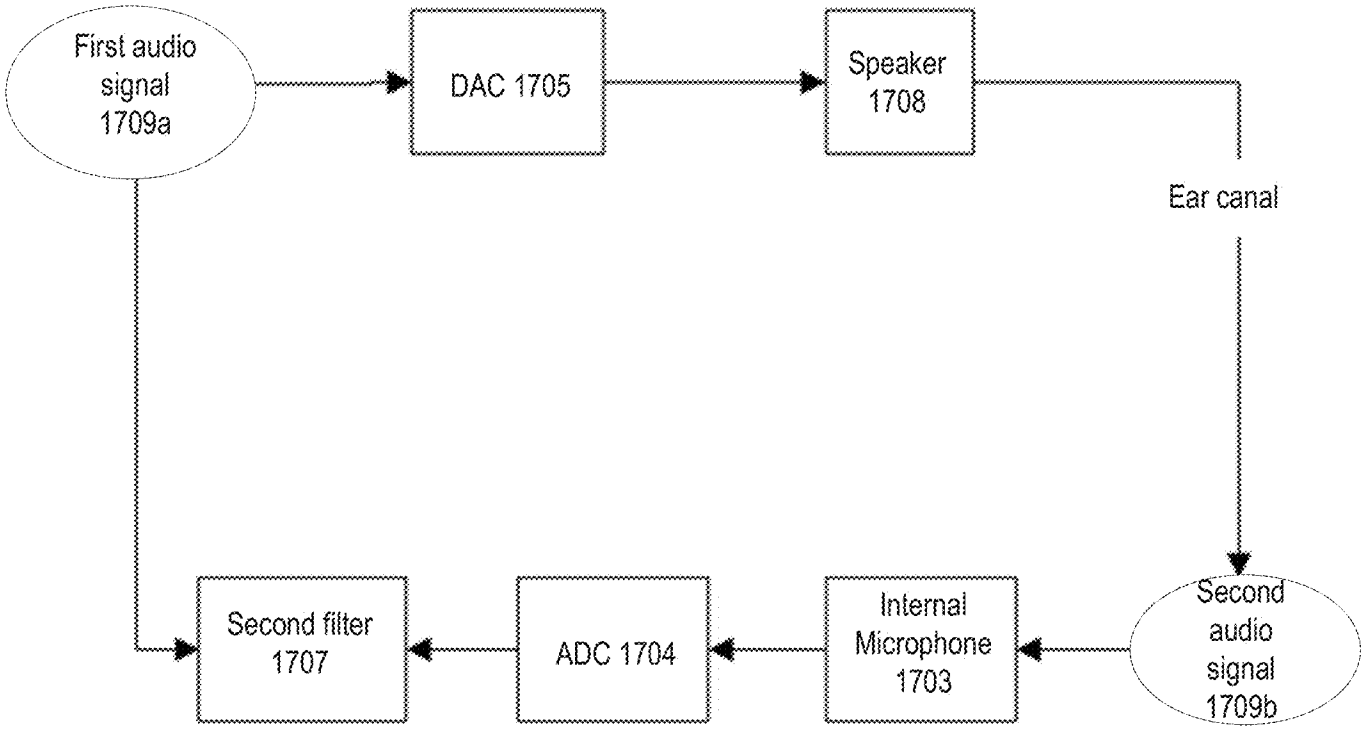
FIG. 17 is an exemplary process for determining the second parameter of a second filter in accordance with an embodiment of the present disclosure.

For example, FIG. 17 is an exemplary process for determining the second parameter of second filter in accordance with an embodiment of the present disclosure. As illustrated in FIG. 17, a first audio signal 1709*a* is transmitted to a second filter 1707 as one input. On the other hand, first audio signal 1709*a* is also converted into an analog signal by a DAC 1705 and is played by a speaker 1708. A second audio signal 1709*b* (e.g., the audio signal obtained by an internal microphone 1703 inside the user's ear canal based on first audio signal 1709*a*) is converted into a digital signal by an ADC 1704 and is transmitted to second filter 1707. The second parameter of second filter 1707 can be determined based on first audio signal 1709*a* and second audio signal 1709*b*.

For example, the second parameter may be determined based on the first audio signal played by speaker 1408 and the second audio signal received by an internal microphone inside the ear canal. The second parameter may be determined according to equation (4):

$$h(n+1) = h(n) + \mu \frac{y(n)e(n)}{y^T(n)y(n)}, \tag{4}$$

where $h(n)=[h_0(n), h_1(n), h_2(n), \ldots, h_{M-1}(n)]^T$, M is the length of the second filter, n is the time point that the sampling is taken, $iny(n)=[y(n), y(n-1), \ldots, y(n-M+1)]^T$, y(n) is the second audio signal generated based on the first audio signal (e.g., passing through the ANC headphone), e(n) is the residual noise signal, determined based on $e(n)=x(n)-h^T(n)y(n)$, where x(n) is the first audio signal. μ is the iterative length of the stride.

In some embodiments, the second filter may further be configured to fit the inverse function of the system function of the speaker to cancel out the effect of the speaker on the system (e.g., the effect on playing fitting noise 1401*c*).

Accordingly, the second parameter can be determined based on the first audio signal played by the speaker and the second audio signal (e.g., obtained using the internal microphone).

Referring back to FIG. 15, in step 1506, a third benchmark parameter for the first filter to perform ANC function may be determined based on a first benchmark parameter and a second benchmark parameter. In some embodiments, the first benchmark parameter and the second benchmark parameter are respectively preset for the first filter and the second filter. The first benchmark parameter and the second benchmark parameter may be determined at least based on laboratory testing, or manually adjusting the first filter and the second filter for the best ANC performance. The system used for determining the first benchmark parameter and the second benchmark parameter is the same as the system for determining the first parameter and the second parameter.

Theoretically, when performing the ANC function, the third benchmark parameter for the first filter (e.g., first filter 1406) is the product of the first benchmark parameter and the second benchmark parameter. In practice, the effect of the internal microphone imposed on the system needs to be canceled when determining the third benchmark parameter. Thus, the third benchmark parameter may be the first benchmark parameter divided by the inverse function of the system function of the internal microphone, multiply by the second benchmark parameter divided by the inverse function of the system function of the internal microphone.

In some embodiments, because the inverse function of the system function of the internal microphone is hard to obtain, the third benchmark parameter may also be determined based on laboratory testing. For example, a tester or an artificial ear may wear the ANC headphones and the parameters of the first filter may be adjusted to obtain the third benchmark parameter. When playing a certain noise by the speaker, the parameter of the first filter may be adjusted such that the residual noise received by the ear is minimal (e.g., the fitting noise can cancel the inside noise to the largest extent). The adjusted parameter may be determined to be the third benchmark parameter.

In step 1508, a calibrate parameter for the second filter to perform the ANC function may be determined based on the first parameter, the second parameter, the first benchmark parameter, and the second benchmark parameter. For example, a Fourier transform may be applied to the first parameter, the second parameter, the first benchmark parameter, and the second benchmark parameter respectively to obtain a first frequency curve $H_1'(w)$, a second frequency curve $H_2'(w)$, a first benchmark frequency curve $H_1(w)$ and a second benchmark frequency curve $H_2(w)$. The calibrated parameter may be determined based on $E(w)=E_1(w)E_2(w)$ where $E_1(w)=H_1'(w)/H_1(w)$ is the first calibrate frequency curve and $E_2(w)=H_2'(w)/H_2(w)$ is the second calibrate frequency curve. In some embodiments, by dividing $H_1'(w)$ by $H_1(w)$ the effect of the internal microphone imposed on the system may be canceled. Similarly, by dividing $H_2'(w)$ by $H_2(w)$ the effect of the speaker imposed on the system may be canceled. The calibrate parameter may be determined based on applying an inverse Fourier transform to the second calibrate frequency curve.

In step 1510, the third benchmark parameter and the calibrated parameter may be applied to the first filter and the second filter, respectively, for performing the ANC function. In some embodiments, at least one of the filter parameters mentioned above can be selected and be set to the ANC headphones by receiving an instruction from the user. For example, the user can use a user device (e.g., a smart phone, tablet, a radio, a music player, an electronic musical instrument, an automobile control station, etc.) to send the instruction associated with selecting filter parameters for the ANC headphones. In some embodiments, the instruction can be sent from the user device to the ANC headphones through a wire or wirelessly (e.g., through Wi-Fi connections, Bluetooth connections, etc.).

In some embodiments, the ANC headphones have N different selectable sets of filter parameters (e.g., parameters for the filter function modules, the talk-through modules and/or the cancel function modules) associated with different working environments or user preferences. In some embodiments, each set of the selectable sets of filter parameters corresponds to an index that is cached or stored in a memory, a storage, or a processor of a user device. For example, N different indexes can correspond to N different selectable sets of filter parameters, respectively. The N different indexes can be stored on the user device and be displayed on a screen of the user device when the user chooses to perform the ANC function. The instruction sent by the user can include at least the index corresponding to a selectable set of filter parameters.

In some embodiments, the ANC headphones can also receive evaluations/feedbacks from the user regarding the performance of the ANC headphones working under different sets of filter parameters being selected. The ANC headphones can select the set of filter parameters with the best evaluations/feedbacks as the filter parameters for the ANC headphones. For example, the user can rate the ANC performance of the ANC headphones using a 1 to 10 scale. The ANC headphones can select the set of filter parameters with the highest rating as the filter parameters to set the ANC headphones.

In some embodiments, the final rating for a selectable set of filter parameters can be determined based on multiple ratings from the same or different users. For example, a selectable set of filter parameters can be rated by the same or different users multiple times. In some embodiments, the final rating of the selectable set of filter parameters can be the average of the multiple ratings. The ANC headphones can take the selectable set of filter parameters with the highest final rating for setting the one or more components of the ANC headphones (e.g., the feedback filter, the feed forward filter, the amplifiers, the echo-cancel filter, the de-leakage filter, the de-sample filter, the up-sample filter, or any of the combination thereof).

The ANC headphones can include a left headphone and a right headphone. In some embodiments, the left headphone and the right headphone can be set according to the same set of filter parameters or can be set to different sets of filter parameters individually. In some embodiments, the left headphone and the right headphone can combinedly communicate with the user device for setting the filter parameters (e.g., receiving instructions about selecting the set of filter parameters), or the left headphone and the right headphone can communicate with the user device separately to receive different sets of filter parameters. For example, the left headphone and the right headphone can have different IDs for communicating with the user device. The user device can send different instructions to the left headphone and the right headphone, respectively, based on their different IDs.

In some embodiments, the ANC headphones can determine the filter parameters according to the user instructions based on different sets of filter parameters pre-stored on the ANC headphones (e.g., stored in a processer, a memory, a storage, etc., of the ANC headphones). In some embodiments, the pre-stored sets of filter parameters are pre-set by the manufacturer, and the user cannot modify the pre-stored filter parameters. In some other embodiments, the pre-stored sets of filter parameters can be modified by the user based on their own preferences. The ANC headphones can test different pre-stored sets of filter parameters and determine the set of filter parameters that has the best ANC performance under the current working scenario.

For example, the ANC headphones can have N sets of pre-stored filter parameters, indexed from 1 to N. Upon receiving the instruction from the user (e.g., turning on the ANC function), the ANC headphones can start to test the ANC performance of each of the N sets of pre-stored filter parameters in turn (e.g., according to any suitable order), for M rounds (e.g., M can be 1, 2, 3, 10, or 15). For example, the separation between different tests can be set as any number between about 100-millisecond to about 3-second (e.g., for 500 ms). When M is larger than 1, the performance of each set of pre-stored filter parameters can be determined based on an average of the M tests' result for the set of pre-stored filter parameters. The ANC headphones can select the set of pre-stored filter parameters with the best ANC performance for setting the ANC headphones.

In some embodiments, the ANC performance can be determined based on the inside noise obtained by the internal microphone and the environmental noise obtained by the external microphone. For example, the larger the environmental noise/inside noise ratio is, the better the ANC performance of the set of pre-stored filter parameters is. In some embodiments, the ANC performance is determined after the environmental noise and/or the inside noise are filtered (e.g., using a low-pass filter with a cut-off frequency of 500 Hz, 1 kHz, 2 kHz, etc., or a high-pass filter with a cut-off frequency of 20 Hz, 50 Hz, 100 Hz, etc.). When setting the low-pass filter and/or the high-pass filter, the width of the bandpass of the feed forward loop and the amplification effect of the noise outside the scope of the bandpass need to be considered. In some embodiments, different weights can be assigned to the ANC performance within different frequency range when evaluating the ANC performance of the set of filter parameters. For example, a lower weight can be assigned to a frequency range susceptible to interferences (e.g., low frequencies such as lower than 50 Hz). The weight can also be set according to the susceptibility of different users.

In some embodiments, the filter parameters of the feed forward loop and the feedback loop can be determined separately. For example, when determining the filter parameters of the feed forward loop, the feedback loop can be closed up, and vice versa. In some embodiments, shifting/switching between different sets of filter parameters is conducted smoothly such that the user will not feel the sudden change and the abrupt noise generated because of the shifting.

In some embodiments, the system parameters for determining the filter function parameters may be the capacitance(s) of the ANC headphone. For example, the system parameters in the Npairs of system parameters and the filter function parameters may be the capacitance(s) of the ANC headphone when being worn by the user, and the current system parameters may be the current capacitance. The filter function parameter can be determined based on the pre-tested relationship revealing the relationship between the capacitance(s) and the filter parameters, similar to the other filter function parameter determination methods disclosed above.

Figure 18:
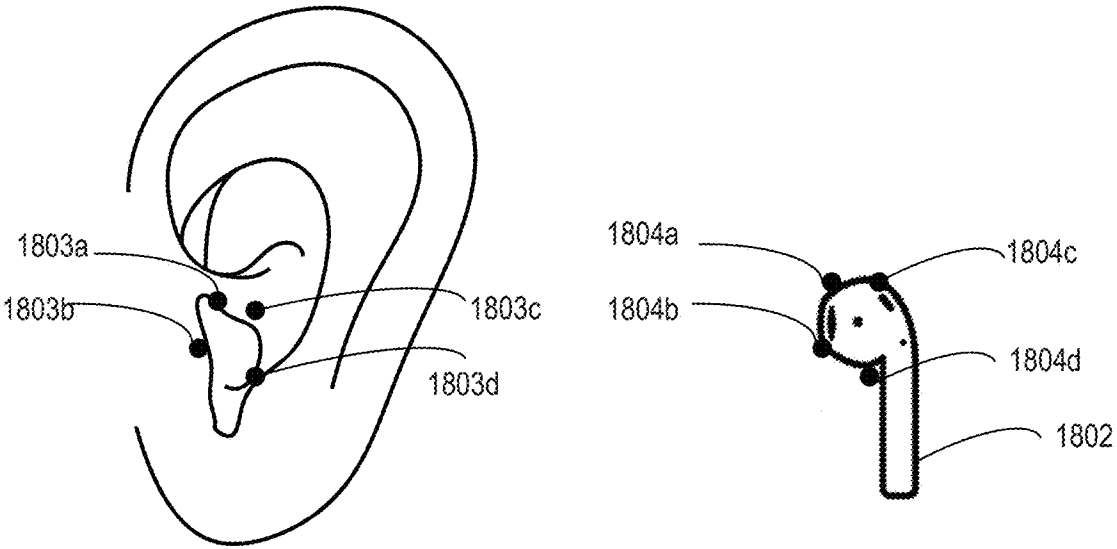
FIG. 18 is a schematic diagram illustrating an exemplary ANC headphone in accordance with an embodiment of the present disclosure.

For example, the current capacitance(s) may be detected using sensors as illustrated in FIG. 18. In some embodiments, the ANC headphone may include a sensor 1802 including multiple input terminals. For example, as illustrated in FIG. 18, sensor 1802 may include four input terminals 1804*a*, 1804*b*, 1804*c* and 1804*d*. When being worn by the user, input terminals 1804*a*, 1804*b*, 1804*c* and 1804*d* may correspond to different ear positions 1803*a*, 1803*b*, 1803*c* and 1803*d*. By determining the capacitances between the input terminals 1804*a*, 1804*b*, 1804*c* and 1804*d*, the ANC headphone may determine the capacitance(s) including the capacitance(s) of the ear along with the user's body.

In some embodiments, the ANC headphone may be worn by the user with different tightness. To reduce the interference caused by the tightness difference of different wearing manners, the ANC headphone may use different methods for determining the current capacitance. For example, the current capacitance may be determined by the sum of the capacitances between input terminals 1804*a*, 1804*b*, 1804*c*, and 1804*d*.

For another example, the current capacitance may be determined by first placing the capacitances between input terminals 1804*a*, 1804*b*, 1804*c* and 1804*d* in order based on the numerical value of the capacitances, then determining the current capacitance based on the sum of a first number of the capacitances, starting from the one with the smallest numerical value. For example, there may be six capacitances between input terminals 1804*a*, 1804*b*, 1804*c* and 1804*d*, and when the first number is 2, the current capacitance may be determined based on the two capacitances with the smallest and the second smallest numerical value. It is understood that the first number may be predetermined and is not limited to the number provided, so long as the first number is smaller than the number of the capacitances between the multiple input terminals. The smaller the numerical value the capacitance is, the less close the input terminal is away from the corresponding ear position. Thus, the numerical value of the capacitances can represent the tightness and the manner the ANC headphone being worn by the user.

For a further example, the capacitances between input terminals 1804*a*, 1804*b*, 1804*c*, and 1804*d* may be grouped based on the direction of the capacitance. The capacitance with the largest numerical value in each group may represent the tightest position of the ear in contact with the ANC headphone in that direction. The current capacitance can be determined based on the sum of the capacitance with the largest numerical value in each certain group.

In some embodiments, the current capacitance can be determined based on a second number of the capacitances in each group, starting from the one with the largest numerical value. In this way, the current capacitance may be a vector and can provide more granularity of the working scenario of the ANC headphone. It is contemplated that the determination of the current capacitance is not limited to the methods disclosed herein. Any other suitable methods for determining the current capacitance of the ANC headphone can be applied for current capacitance determination.

Figure 19:
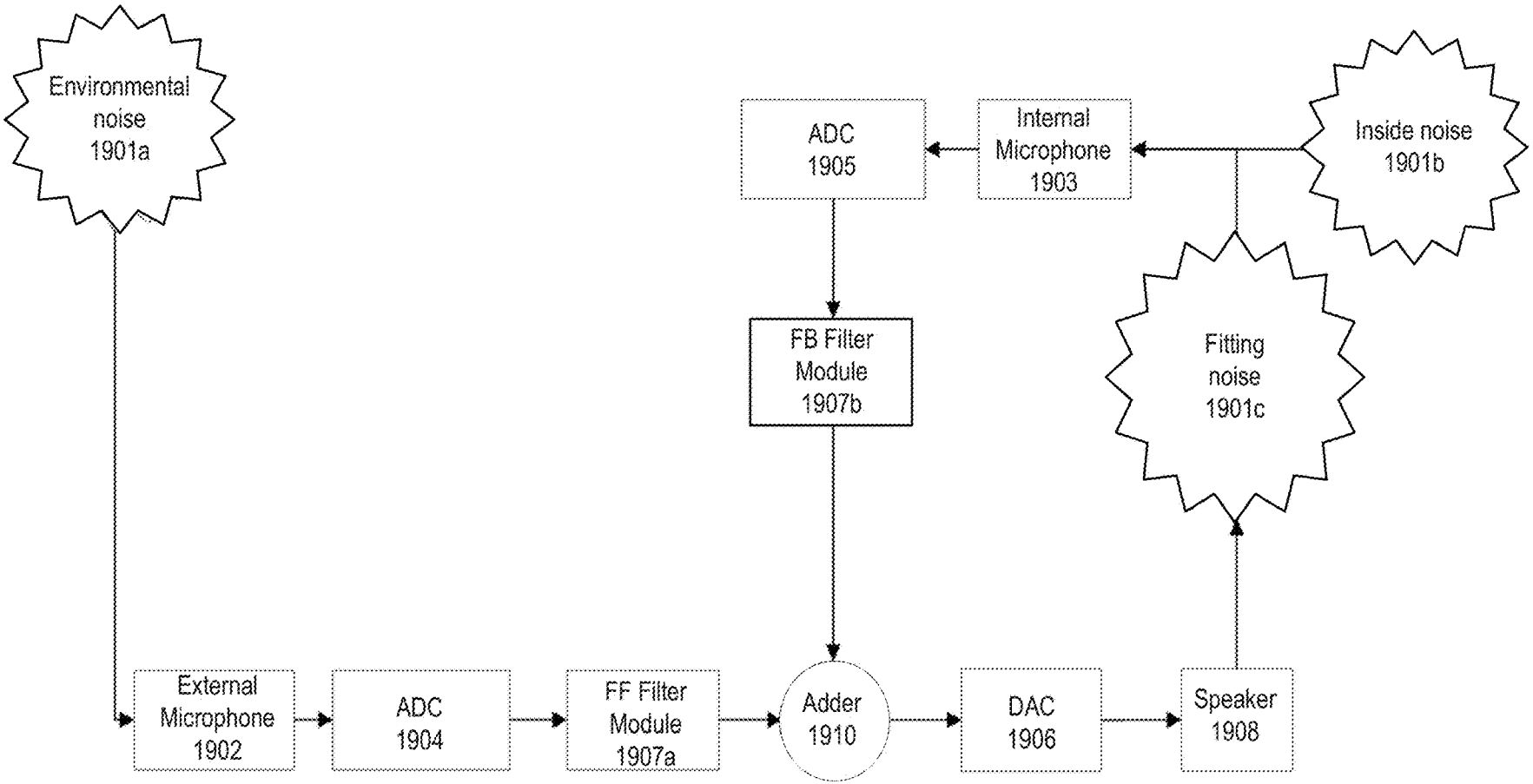
FIG. 19 is an exemplary process for determining the capacitance(s) of the ANC headphone in accordance with an embodiment of the present disclosure

In some embodiments, the pre-tested relationship revealing the relationship between the capacitance(s) and the filter parameters may be used for determining the current filter parameters for ANC. For example, FIG. 19 is an exemplary process for determining the filter function parameters in accordance with an embodiment of the present disclosure. As illustrated in FIG. 19, environmental noise 1901*a* can be obtained by an external microphone 1902 and be converted by ADC 1904. The converted signal is transmitted to a feed forward filter 1907*a* for filtering. On the other hand, internal noise 1901*b* may be obtained by an internal microphone 1903*a* and be converted by ADC 1905. The converted signal is transmitted to a feedback filter 1907*b* for filtering. The filtered signals from feed forward filter 1907*a* and feedback filter 1907*b* are combined by an adder 1910, be converted by DAC 1906, and be played by a speaker 1908 to generate fitting noise signal 1901*c*. Fitting noise signal 1901*c* can also be obtained by external microphone 1902. In some embodiments, by adjusting the parameters of feed forward filter 1907*a* and feedback filter 1907*b*, fitting noise signal 1901*c* can cancel out internal noise 1901*b* to the greatest extent. The parameters of feed forward filter 1907*a* and feedback filter 1907*b* under such conditions can be determined as the filter function parameters.

In some embodiments, the relationship between the filter function parameters, and the corresponding capacitances between input terminals 1804*a*, 1804*b*, 1804*c*, and 1804*d* can be determined based on the pre-tested data. For example, the corresponding capacitances between input terminals 1804*a*, 1804*b*, 1804*c*, and 1804*d* can be obtained and be associated with the determined filter function parameter as a data point. In some embodiments, N different tests simulating different working scenarios may be conducted for obtaining the relationship between the filter function parameters and the capacitance(s). In some embodiments, the N different tests can be conducted on a tester. In some other embodiments, N different tests can be conducted on an artificial ear, simulating the real condition of a real human user.

For another example, the relationship between the filter function parameters, and the corresponding capacitances between input terminals 1804*a*, 1804*b*, 1804*c* and 1804*d* revealed by the pre-tested data can be determined using intermediary parameters such as the transfer function of the ANC headphone. For example, the relationship between the filter function parameters, and the transfer function may be determined using the methods disclosed hereabove. The relationship between the transfer parameters and the corresponding capacitances between input terminals 1804*a*, 1804*b*, 1804*c* and 1804*d* may then be determined by obtaining the capacitances between input terminals 1804*a*, 1804*b*, 1804*c* and 1804*d* corresponding to each determined transfer function. The relationship between the filter function parameters and the corresponding capacitances can then be determined based on the relationship between the filter function parameters, and the transfer function, and the relationship between the transfer function and the corresponding capacitances.

In some embodiments, the ANC headphone can further determine if the ANC headphone is worn by the user. For example, the ANC headphone can determine if the current capacitance is lower than a predetermined threshold. In some embodiments, the ANC headphone can activate the ANC function only when it is determined that the ANC headphone is worn by the user.

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure or the appended claims in any way.

While the present disclosure has been described herein with reference to exemplary embodiments for exemplary fields and applications, it should be understood that the present disclosure is not limited thereto. Other embodiments and modifications thereto are possible and are within the scope and spirit of the present disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments may perform functional blocks, steps, operations, methods, etc. using orderings different than those described herein.

The breadth and scope of the present disclosure should not be limited by any of the above-described exemplary embodiments, but should be defined only in accordance with the following claims and their equivalents.

What is claimed is:

1. A headphone, comprising:

a speaker configured to play an audio of interest based on an audio source signal;

an internal microphone configured to obtain a first mixed audio signal comprising a first noise signal and the audio of interest played by the speaker;

an external microphone configured to obtain a second mixed audio signal comprising a second noise signal and a leakage associated with the audio of interest;

a processor configured to:

determine a current system parameter of the headphone based on the first mixed audio signal; and determine a current parameter of a de-leakage filter based on the current system parameter of the headphone and pre-tested data; and the de-leakage filter configured to perform a de-leakage function based on the second mixed audio signal and the current parameter of the de-leakage filter.

2. The headphone of claim 1, wherein the pre-tested data comprises one or more pairs of predetermined de-leakage filter parameters and predetermined system parameters of the headphone, with each pair comprising a predetermined de-leakage filter parameter and a predetermined system parameter of the headphone corresponding to the predetermined de-leakage filter parameter.

3. The headphone of claim 2, wherein to determine the current parameter of the de-leakage filter, the processor is further configured to:

determine, from the one or more pairs, a corresponding pair of predetermined de-leakage filter parameters and predetermined system parameters of the headphone based on the current system parameter of the headphone; and determine the current parameter of the de-leakage filter based on the corresponding pair of predetermined de-leakage filter parameters and predetermined system parameters of the headphone.

4. The headphone of claim 1, wherein:

the de-leakage filter is configured using the current parameter of the de-leakage filter; and the de-leakage filter is configured to generate a de-leakage signal based on a noise-controlled audio signal.

5. The headphone of claim 4, wherein the second mixed audio signal further comprises a talk-through sound of interest, and the headphone further comprises:

an adder configured to produce an output signal by adding the de-leakage signal to the second mixed audio signal to cancel out the leakage from the second mixed audio signal; and a talk-through filter configured to filter out the second noise signal from the output signal of the adder to generate a leakage-canceled talk-through audio signal.

6. The headphone of claim 4, further comprising:

a feedback loop configured to generate a first noise-cancel signal from the first mixed audio signal; and a feed forward loop configured to generate a second noise-cancel signal from the second mixed audio signal.

7. The headphone of claim 6, wherein the noise-controlled audio signal is a sum of the audio source signal, the first noise-cancel signal, and the second noise-cancel signal.

8. The headphone of claim 6, wherein the noise-controlled audio signal is a sum of the first noise-cancel signal and the second noise-cancel signal.

9. The headphone of claim 1, wherein the current system parameter of the headphone comprises at least one of a transfer function of the headphone, a time domain distribution, a frequency domain distribution, an energy in the time domain, or an energy in the frequency domain of the first mixed audio signal.

10. A system for playing an audio source signal in a headphone, comprising:

a memory storing code; and a processor coupled to the memory, wherein when the code is executed, the processor is configured to:

receive, from an internal microphone of the headphone, a first mixed audio signal comprising a first noise signal and an audio of interest played by a speaker of the headphone;

receive, from an external microphone of the headphone, a second mixed audio signal comprising a second noise signal and a leakage associated with the audio of interest;

determine a current system parameter of the headphone based on the first mixed audio signal;

determine a current parameter of a de-leakage filter based on the current system parameter of the headphone and pre-tested data; and apply the current parameter of the de-leakage filter to perform a de-leakage function on the headphone based on the second mixed audio signal and the current parameter of the de-leakage filter.

11. The system of claim 10, wherein the pre-tested data comprises one or more pairs of predetermined de-leakage filter parameters and predetermined system parameters of the headphone, with each pair comprising a predetermined de-leakage filter parameter and a predetermined system parameter of the headphone corresponding to the predetermined de-leakage filter parameter.

12. The system of claim 11, wherein to determine the current parameter of the de-leakage filter, the processor is further configured to:

determine, from the one or more pairs, a corresponding pair of predetermined de-leakage filter parameters and predetermined system parameters of the headphone based on the current system parameter of the headphone; and determine the current parameter of the de-leakage filter based on the corresponding pair of predetermined de-leakage filter parameters and predetermined system parameters of the headphone.

13. A method for performing a de-leakage function in a headphone, comprising:

playing, by a speaker of the headphone, an audio of interest based on an audio source signal;

obtaining, by an internal microphone of the headphone, a first mixed audio signal comprising a first noise signal and the audio of interest played by the speaker;

obtaining, by an external microphone of headphone, a second mixed audio signal comprising a second noise signal and a leakage associated with the audio of interest;

determining, by a processor, a current system parameter of the headphone based on the first mixed audio signal;

determining, by the processor, a current parameter of a de-leakage filter based on the current system parameter of the headphone and pre-tested data; and applying, by the processor, the current parameter of the de-leakage filter to perform the de-leakage function on the headphone based on the second mixed audio signal and the current parameter of the de-leakage filter.

14. The method of claim 13, wherein the pre-tested data comprises one or more pairs of predetermined de-leakage filter parameters and predetermined system parameters of the headphone, with each pair comprising a predetermined de-leakage filter parameter and a predetermined system parameter of the headphone corresponding to the predetermined de-leakage filter parameter.

15. The method of claim 13, wherein applying the current parameter of the de-leakage filter to perform the de-leakage function on the headphone comprises:

configuring the de-leakage filter using the current parameter of the de-leakage filter; and generating a de-leakage signal based on a noise-controlled audio signal.

16. The method of claim 15, wherein the second mixed audio signal further comprises a talk-through sound of interest, and the method further comprises:

adding the de-leakage signal to the second mixed audio signal to produce an output signal in which the leakage is canceled out from the second mixed audio signal; and filtering out the second noise signal from the output signal to generate a leakage-canceled talk-through audio signal.

17. The method of claim 15, further comprising:

generating, by a feedback loop, a first noise-cancel signal from the first mixed audio signal; and generating, by a feed forward loop, a second noise-cancel signal from the second mixed audio signal.

18. The method of claim 17, wherein the noise-controlled audio signal is a sum of the audio source signal, the first noise-cancel signal, and the second noise-cancel signal.

19. The method of claim 17, wherein the noise-controlled audio signal is a sum of the first noise-cancel signal and the second noise-cancel signal.

20. The method of claim 13, wherein the current system parameter of the headphone comprises at least one of a transfer function of the headphone, a time domain distribution, a frequency domain distribution, an energy in the time domain, or an energy in the frequency domain of the first mixed audio signal.

* * * * *